US010915121B2

(12) United States Patent
Magod Ramakrishna et al.

(10) Patent No.: US 10,915,121 B2
(45) Date of Patent: Feb. 9, 2021

(54) LOW DROPOUT REGULATOR (LDO) WITH FREQUENCY-DEPENDENT RESISTANCE DEVICE FOR POLE TRACKING COMPENSATION

(71) Applicant: TEXAS INSTRUMENTS INCORPORATED, Dallas, TX (US)

(72) Inventors: Raveesh Magod Ramakrishna, Richardson, TX (US); Sanjeev Manandhar, Tuscon, AZ (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 16/184,414

(22) Filed: Nov. 8, 2018

(65) Prior Publication Data

US 2019/0258282 A1 Aug. 22, 2019

Related U.S. Application Data

(60) Provisional application No. 62/632,093, filed on Feb. 19, 2018.

(51) Int. Cl.
*G05F 1/565* (2006.01)

(52) U.S. Cl.
CPC ..... *G05F 1/565* (2013.01)

(58) Field of Classification Search
CPC . G05F 1/56; G05F 1/565; G05F 1/575; G05F 1/59; G05F 3/26
See application file for complete search history.

(56) References Cited

U.S. PATENT DOCUMENTS 6,188,212 B1 * 2/2001 Larson ..... G05F 1/56 323/274
6,600,299 B2 * 7/2003 Xi ..... G05F 1/575 323/280
6,603,292 B1 8/2003 Schouten et al.
6,977,490 B1 * 12/2005 Zhang ..... G05F 1/575 323/280

(Continued)

OTHER PUBLICATIONS

Magod, Raveesh, et al. "1.24 μA Quiescent Current NMOS Low Dropout Regulator with Integrated Low-Power Oscillator Driven Charge-Pump and Switched-Capacitor Pole Tracking Compensations." IEE Journal of Solid-State circuits, vol. 53, No. 8, Aug. 2018, pp. 2356-2367.

*Primary Examiner* — Gary L Laxton
(74) *Attorney, Agent, or Firm* — Michael A. Davis, Jr.; Charles A. Brill; Frank D. Cimino

(57) ABSTRACT

A system includes a low dropout regulator (LDO) circuit. The LDO circuit includes an error amplifier with an input node, a reference node, and an output node. The LDO circuit also includes a pass transistor with a control terminal, a first current terminal, and a second current terminal. The control terminal is coupled to the output node of the error amplifier, the first current terminal is coupled to a voltage source node, and the second current terminal is coupled to an LDO output node. The LDO output node is coupled to the input node of the error amplifier. The LDO circuit also includes a switched-capacitor network coupled between error amplifier and the pass transistor. The switched-capacitor network comprises a pair of switches and a current-controlled oscillator coupled to control terminals of the switches.

17 Claims, 14 Drawing Sheets

(56) References Cited

U.S. PATENT DOCUMENTS

| | | | | |
|---|---|---|---|---|
| 7,863,873 | B2 * | 1/2011 | Hou | G05F 1/575 323/271 |
| 8,115,463 | B2 | 2/2012 | Wang | |
| 8,169,203 | B1 * | 5/2012 | Vemula | G05F 1/575 323/273 |
| 8,248,150 | B2 * | 8/2012 | Tadeparthy | G05F 1/56 327/534 |
| 8,421,426 | B2 * | 4/2013 | La Rosa | H05B 33/0812 323/272 |
| 8,816,658 | B1 * | 8/2014 | De Vita | G05F 1/575 323/275 |
| 9,778,672 | B1 * | 10/2017 | Gao | G05F 1/575 |
| 10,082,812 | B2 * | 9/2018 | Zhou | G05F 1/565 |
| 2010/0066320 | A1 * | 3/2010 | Dasgupta | G05F 1/575 323/273 |
| 2017/0090494 | A1 * | 3/2017 | Cui | G05F 1/562 |

* cited by examiner

1500

1700

1602

1604

1606

1608

LOW DROPOUT REGULATOR (LDO) WITH FREQUENCY-DEPENDENT RESISTANCE DEVICE FOR POLE TRACKING COMPENSATION

RELATED APPLICATIONS

This application claims priority to U.S. Provisional Application No. 62/632,093, filed Feb. 19, 2018, titled "Switched-capacitor pole tracking compensation scheme for low quiescent current LDOs", and hereby incorporated herein by reference.

BACKGROUND

Low dropout (LDO) regulators with low quiescent current (the current drawn from the input supply voltage in a no-load and non-switching, but enabled condition) are widely used for supply regulation of portable devices, low power system-on-chip (SoC) integrated circuits, always-on Internet-of-things (IoT) sensor systems and other low power consumption applications. An example LDO is a closed-loop with an error amplifier that drives a pass device to regulate an output voltage. The output voltage is fed back to the error amplifier, which compares the output voltage to a reference voltage. Often a low output impedance buffer is used between the error amplifier and the pass device.

SUMMARY

In accordance with at least one example of the disclosure, a system comprises a low dropout regulator (LDO) circuit, wherein the LDO circuit comprises an error amplifier with an input node, a reference node, and an output node. The LDO circuit also comprises a pass transistor with a control terminal, a first current terminal, and a second current terminal, wherein the control terminal is coupled to the output node of the error amplifier, the first current terminal is coupled to a voltage source node, and the second current terminal is coupled to an LDO output node. The LDO circuit also comprises a switched-capacitor network coupled between the error amplifier and the pass transistor. The switched-capacitor network comprises a pair of switches and a current-controlled oscillator coupled to control terminals of the switches.

In accordance with at least one example of the disclosure, an LDO circuit comprises an error amplifier with an input node, a reference node, and an output node. The LDO circuit also comprises a pass device configured to pass current to an LDO output node based on a control signal, wherein the LDO output node is coupled to the input node of the error amplifier. The LDO circuit also comprises a frequency-dependent resistance device coupled between the error amplifier and the pass device, wherein the frequency-dependent resistance device is adjusted based on a current at the LDO output node.

In accordance with at least one example of the disclosure, a method for operating an LDO comprises providing a voltage source to a first current terminal of a pass transistor. The method also comprises regulating current to a load coupled to a second current terminal of the pass transistor by adjusting gate drive signals to a control terminal of the pass transistor. Adjusting gate drive signals to the control terminal of the pass transistor is based on a closed-loop circuit with an error amplifier. Also, adjusting gate drive signals to the control terminal of the pass transistor comprises changing a resistance value at an output node of the error amplifier using a frequency-dependent resistor.

BRIEF DESCRIPTION OF THE DRAWINGS

For a detailed description of various examples, reference will now be made to the accompanying drawings in which.

DETAILED DESCRIPTION

Figure 1:
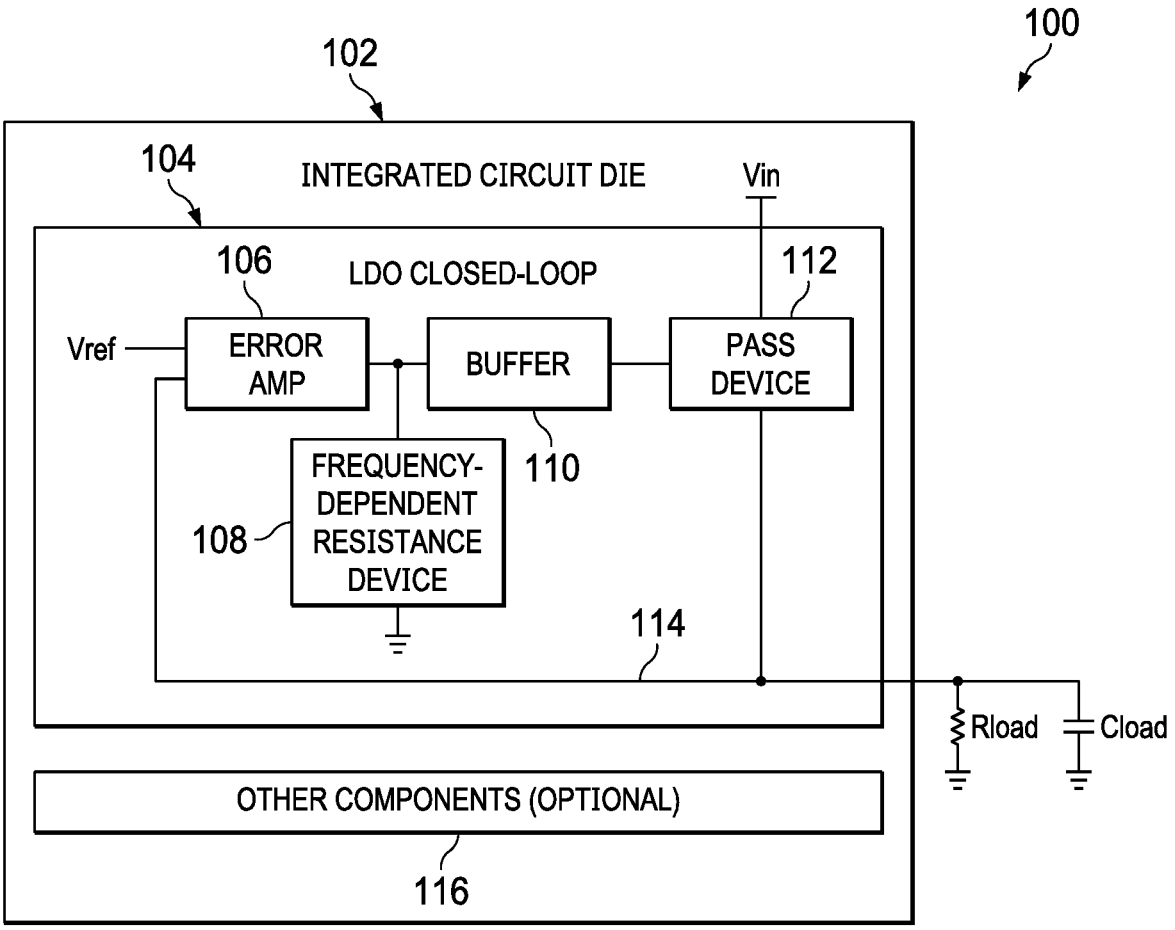
FIG. 1 shows a block diagram of an integrated circuit (IC) die with a low dropout regulator (LDO) circuit in accordance with various examples.

Disclosed herein are low dropout regulator (LDO) topologies with a frequency-dependent resistance device for pole tracking compensation, and related systems and methods. As used herein, a "frequency-dependent resistance device" refers to a resistor or network of components between two nodes, where the resistance or impedance between the two nodes varies as a function of frequency. In some examples, the frequency that causes the resistance or impedance of a frequency-dependent resistance device to vary is a control signal frequency (e.g., a clock frequency for one or more switches). In other examples, the frequency that causes the resistance or impedance of a frequency-dependent resistance device to vary is the frequency of the signal conveyed between the two nodes.

By changing the resistance or impedance of a frequency-dependent resistance device as a function of load current, an LDO circuit is modified such that a low frequency zero for the LDO closed-loop is provided while tracking the output pole as a function of load current to provide closed-loop stability. In some examples, a frequency-dependent resistance device is a switched-capacitor network (sometimes referred to as a switched-capacitor resistor or impedance device). An example switched-capacitor network includes a capacitor coupled between a switch node (between two switches) and a ground node. The switched-capacitor network also includes a current-controlled oscillator configured to provide control signals to the switches, where a switching frequency of the control signals is based on a load current (e.g., a mirrored load current value).

LDO stability is a function of closed-loop poles. In an example LDO closed-loop with an error amplifier and a pass transistor (an example of a pass device configured to pass current based on a control signal), the poles include an error amplifier output pole (Pamp), a pass transistor parasitic gate capacitance pole (Pgate), and an output pole (Pout) at the output of the LDO. When a low output impedance buffer is used between the error amplifier and the pass transistor, Pgate is usually higher than the unity gain bandwidth (UGB) of the LDO loop and does not affect its stability. Meanwhile, Pout is a function of the LDO load current and is at a very low frequency during light load current conditions. Pout increases in frequency as the load current increases. In low quiescent current (lq) LDOs, limited bias current results in a high output impedance for the error amplifier. Therefore, Pamp which is inversely proportional to the output impedance of the error amplifier, is also at a very low frequency.

To improve the transient response of low quiescent current LDOs without compromising current efficiency, use of load current dependent bias current scaling (an adaptive biasing scheme) may be employed. However, at light load currents, both Pout and Pamp are at a very low frequency and close to each other. This results in a low phase margin and reduces LDO stability. With adaptive biasing, Pamp also increases in frequency as the load current increases resulting in additional challenges in attaining LDO stability. To overcome the challenges of adaptive biasing, the proposed LDO topologies employ a frequency-dependent resistance device in the LDO closed-loop, where the resistance of the frequency-dependent resistance device changes as a function of load current.

An example LDO circuit includes an error (differential) amplifier with an input node, a reference node, and an output node. The LDO circuit also includes a pass transistor with a control terminal, a first current terminal, and a second current terminal, where the control terminal is coupled to the output node of the error amplifier, the first current terminal is coupled to a voltage source node, and the second current terminal is coupled to an LDO output node. The LDO circuit also comprises a switched-capacitor network configured to introduce a zero into the LDO circuit. In some examples, the switched-capacitor network comprises a pair of switches with a switching frequency that changes as a function of a load current such that the zero tracks an output pole of the LDO circuit. In different examples, the switched-capacitor network is coupled to different nodes of an LDO circuit (e.g., at the error amplifier output, the pass transistor control input, or the pass transistor output. In some examples, the switched-capacitor network is replaced with another type of frequency-dependent resi, where the resistance is adjusted based on a load current. To provide a better understanding, various LDO circuit options, switched-capacitor network options, and related systems are described using the figures as follows.

FIG. 1 shows a block diagram of an integrated circuit (IC) die 102 with an LDO circuit 104 in accordance with various examples. In FIG. 1, the LDO circuit 104 comprises an error amplifier 106 that functions as an error amplifier between a reference voltage (Vref) and a feedback signal 114 for the LDO circuit 104, where the feedback signal 114 is also the output signal applied to an output capacitor (Cload) and a resistive load (Rload). The output of the error amplification 106 is applied to a control terminal for the pass device 112. In some examples, a buffer 110 is positioned between the output of the error amplifier 106 and a control terminal of the pass device 112 to drive the control terminal as desired. Depending on the control signal applied to the control terminal of the pass device 112, the pass device 112 allows current flow based on a supply voltage (Vin). In some examples, the pass device 112 is an NMOS transistor. In other examples, the pass device 112 is a PMOS transistor.

As shown in FIG. 1, the LDO circuit 104 also comprises a frequency-dependent resistance device 108 between the output of the error amplifier 106 and a ground node. In at least some examples, the frequency-dependent resistance device 108 provides a low frequency zero for the circuit 104 while tracking the output pole as a function of load current to provide closed-loop stability. In different examples, the position of the frequency-dependent resistance device 108 in the LDO circuit 104 varies. In some examples, the frequency-dependent resistance device 108 is between the buffer 110 and the pass device 112. In other examples, the frequency-dependent resistance device 108 is along the path that conveys the feedback signal 114 from the output of the pass device 112 to the input of the error amplifier 106. Additional details and options for the frequency-dependent resistance device 108 are provided later.

In some examples, the IC die 102 includes only the LDO circuit 104 (e.g., the IC die 102 is a stand-alone LDO device configured to regulate an output voltage to a load based on a higher voltage). In other examples, the IC die 102 includes other components 116. In one example, the other components 116 include circuitry powered by the LDO circuit 104. In some examples, if the other components 116 correspond to a load to be driven by the LDO circuit 104, Rload is included with the IC die 102. In such case, Cload is either included or not included with the IC die 102. In other examples, both Rload and Cload are external to the IC die 102.

Figure 2A:
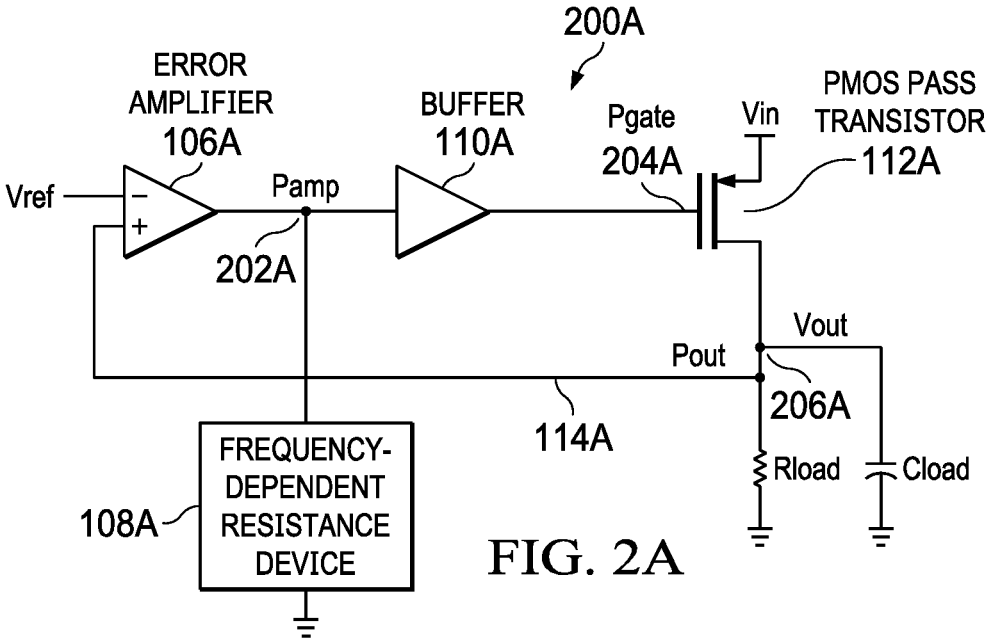
FIG. 2A shows a schematic diagram of an LDO circuit with a PMOS pass transistor in accordance with various examples.

FIG. 2A shows a schematic diagram of an LDO circuit 200A with a PMOS pass transistor 112A in accordance with various examples. In FIG. 2A, the LDO circuit 200A includes an error amplifier 106A, a buffer 110A, and a frequency-dependent resistance device 108A (examples of the error amplifier 106, the buffer 110, and the frequency-dependent resistance device 108 in FIG. 1). The PMOS pass transistor 112A is an example of the pass device 112 in FIG. 1. Also represented in FIG. 2A are the poles for the LDO circuit 200A corresponding to nodes 202A, 204A, and 206A. More specifically, node 202A corresponds to a first pole (Pamp) at the output of the error amplifier 106A, node 204A corresponds to a second pole (Pgate) at the control terminal of the PMOS pass transistor 112A, and node 206A corresponds to a third pole at the output of the LDO circuit 200A.

Figure 2B:
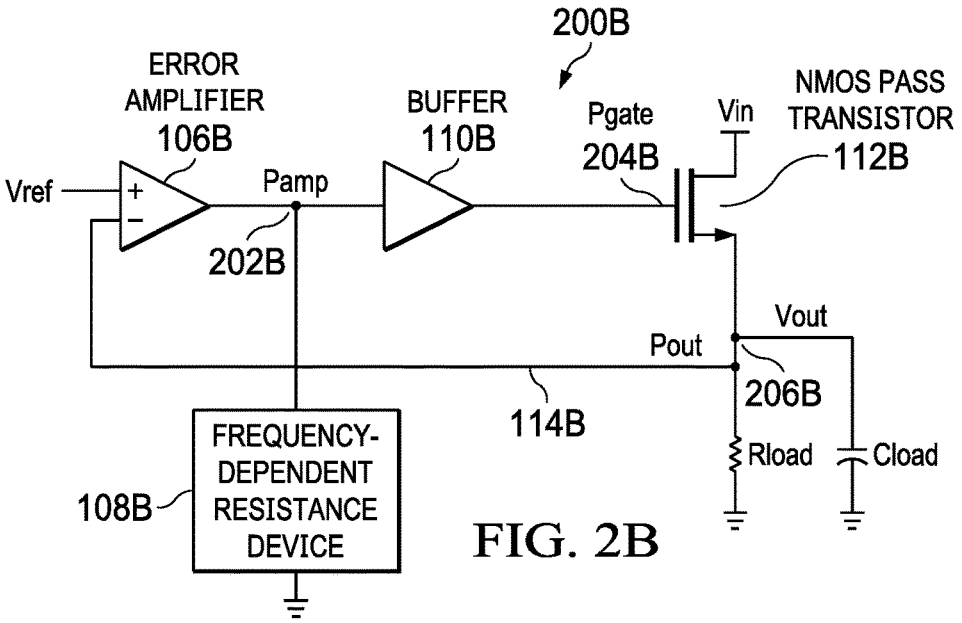
FIG. 2B shows a schematic diagram of an LDO circuit with an NMOS pass transistor in accordance with various examples.

FIG. 2B shows a schematic diagram of an LDO circuit 200B with an NMOS pass transistor 112B in accordance with various examples. In FIG. 2B, the LDO circuit 200B includes an error amplifier 106B, a buffer 110B, and a frequency-dependent resistance device 108B (examples of the error amplifier 106, the buffer 110, and the frequency-dependent resistance device 108 in FIG. 1). The NMOS pass transistor 112B is an example of the pass device 112 in FIG. 1. Also represented in FIG. 2B are the poles for the LDO circuit 200B corresponding to nodes 202B, 204B, and 206B. More specifically, node 202B corresponds to a first pole (Pamp) at the output of the error amplifier 106B, node 204B corresponds to a second pole (Pgate) at the control terminal of the NMOS pass transistor 112B, and node 206B corresponds to a third pole at the output of the LDO circuit 200B.

Figure 3:
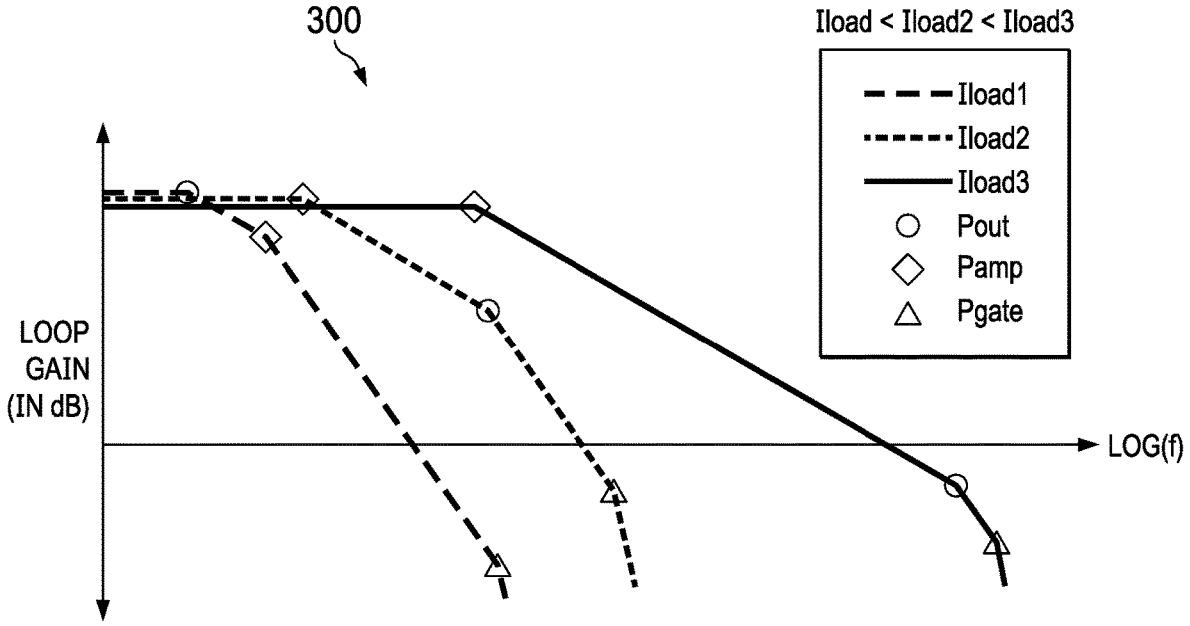
FIG. 3 shows a graph representing loop gain as a function of load current and frequency in accordance with various examples.

FIG. 3 shows a graph 300 representing loop gain as a function of load current and frequency in accordance with various examples. In graph 300, loop gain at low frequencies (near zero) is approximately the same for different load currents (Iload1, Iload2, and Iload3), where Iload1<Iload2<Iload3. As represented in graph 300, loop gain and the position of the closed-loop poles (Pout, Pamp, Pgate) varies as load current increases. In particular, Pout is affected by load current and frequency variations. Using a frequency-dependent resistance device at the output of an error amplifier in an LDO closed-loop circuit (see e.g., FIGS. 1, 2A, 2B) provides a low frequency zero for the closed-loop circuit while tracking the output pole as a function of load current to provide closed-loop stability.

Figure 4:
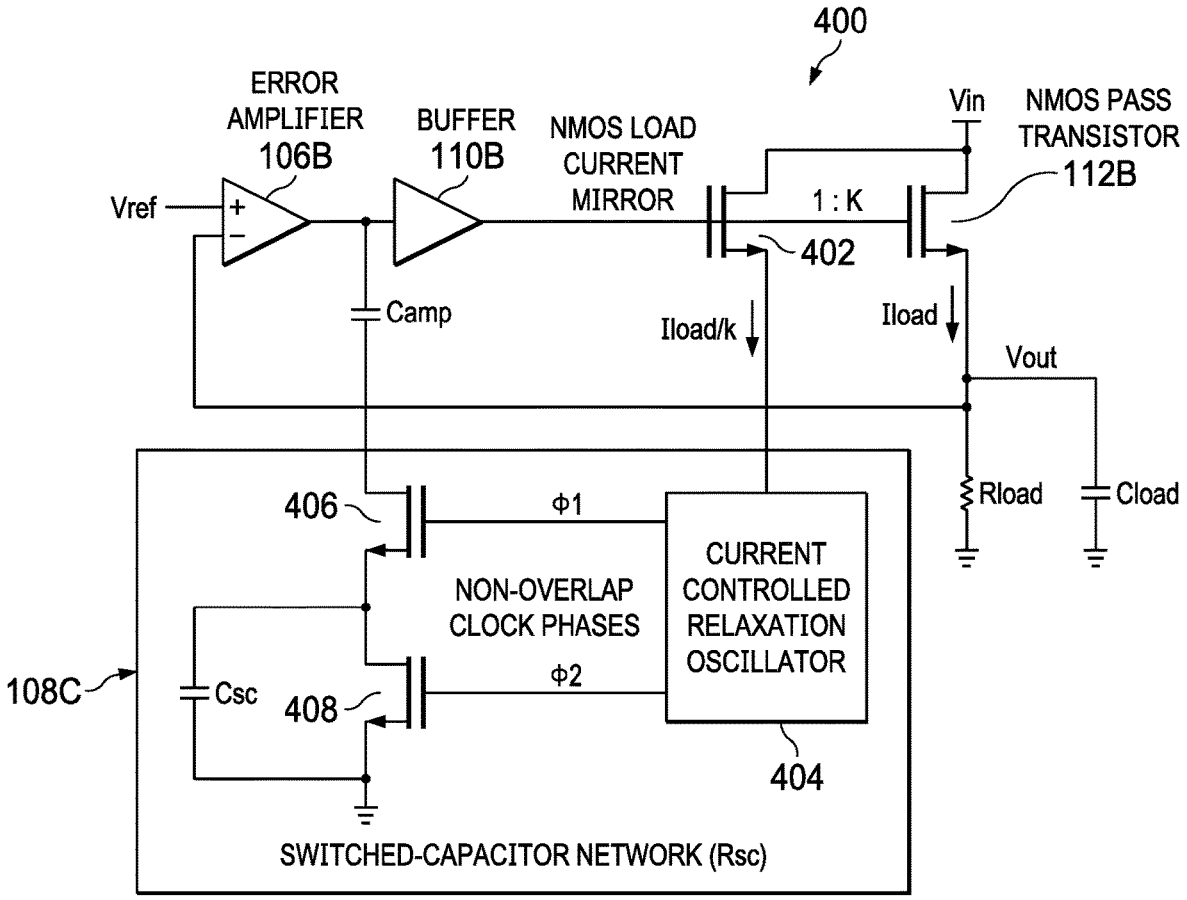
FIG. 4 shows a schematic diagram of another LDO circuit with an NMOS pass transistor in accordance with various examples.

FIG. 4 shows a schematic diagram of another LDO closed-loop circuit 400 with an NMOS pass transistor 112B in accordance with various examples. As shown in FIG. 4, the LDO circuit 400 includes many of the LDO circuit components discussed in FIG. 2B, including the error amplifier 106B, the buffer 110B, the NMOS pass transistor 112B, and a switched-capacitor network 108C (an example of the frequency-dependent resistance device 108 in FIG. 1, the frequency-dependent resistance device 108A in FIG. 2A, or the frequency-dependent resistance device 108B in FIG. 2B).

More specifically, the switched-capacitor network 108C of FIG. 4 includes a current-controlled relaxation oscillator 404 that provides non-overlapping clock phases (ϕ1 and ϕ2) to drive a pair of transistors 406 and 408 that operate as switches, where each of the transistors 406 and 408 have respective control terminals, first current terminals, and second current terminals. More specifically, ϕ1 drives the control terminal of the transistor 406, and ϕ2 drives the control terminal of the transistor 408. In operation, the transistors 406 and 408 charge and discharge a switched-capacitor (labeled Csc) for the switched-capacitor network 108C, where Csc has a first electrode coupled to the second current terminal of the transistor 406 and to a first current terminal of the transistor 408. The second electrode of Csc is coupled to a ground node. Meanwhile, the first current terminal of the transistor 406 is coupled to a capacitor, Camp, which represents an internal capacitance for the error amplifier 106B. Finally, the second current terminal of the transistor 408 coupled to a ground node.

To change a resistance of the switched-capacitor network 108C, the current-controlled relaxation monitors the load current (Iload) via a current mirror circuit 402, where the load current mirror value is proportional to the load current (e.g., load current mirror value=Iload/K). Thus, load current mirror value changes when Iload changes, resulting in the current-controlled relaxation oscillator 404 changing the frequency and/or phase of ϕ1 and ϕ2. In one example, when Iload increases, the current-controlled relaxation oscillator 404 causes ϕ1 and ϕ2 to increase in frequency, which results in a lower resistance for the switched-capacitor network 108C. On the other hand, when Iload decreases, the current-controlled relaxation oscillator 404 causes ϕ1 and ϕ2 to decrease in frequency, which results in a higher resistance for the switched-capacitor network 108C.

Figure 5A:
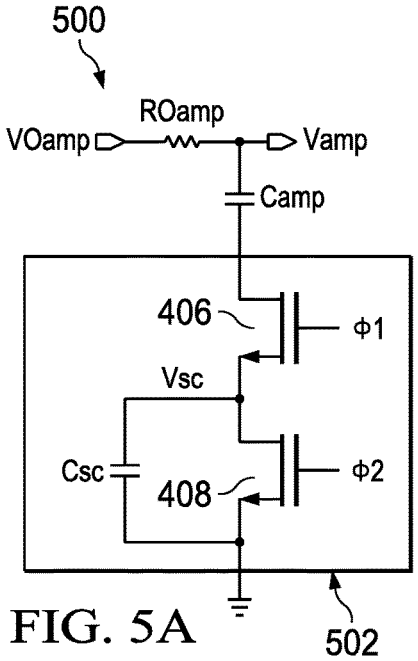
FIG. 5A shows a schematic diagram of a switched-capacitor network and related signals of an LDO circuit in accordance with various examples.

FIG. 5A shows a schematic diagram of a switched-capacitor network 502 and related signals of an LDO circuit 500 in accordance with various examples. In different examples, the LDO circuit 500 corresponds to the LDO closed-loop circuit 104 of FIG. 1, the LDO circuit 200A of FIG. 2A, the LDO circuit 200B of FIG. 2B, or the LDO circuit 400 of FIG. 4. In FIG. 5A, the switched-capacitor network 502 includes the pair of transistors 406 and 408 introduced in FIG. 4, where ϕ1 and ϕ2 drive the control terminals for the respective transistors 406 and 408. More specifically, ϕ1 drives the control terminal of the transistor 406, and ϕ2 drives the control terminal of the transistor 408. In operation, the transistors 406 and 408 charge and discharge Csc as described for FIG. 4. Again, Csc has a first electrode coupled to the second current terminal of the transistor 406 and to a first current terminal of the transistor 408. The second electrode of Csc is coupled to a ground node. Meanwhile, the first current terminal of the transistor 406 is coupled to Camp, and the second current terminal of the transistor 408 coupled to a ground node. The switched-capacitor network 502 is coupled to an error amplifier of an LDO circuit 500, which is represented by an output resistance (ROamp) and a capacitance (Camp) in FIG. 5. The voltage at Camp is labeled Vamp, the voltage at Csc is labeled Vsc, and the output voltage from the error amplifier is labeled VOamp.

Figure 5B:
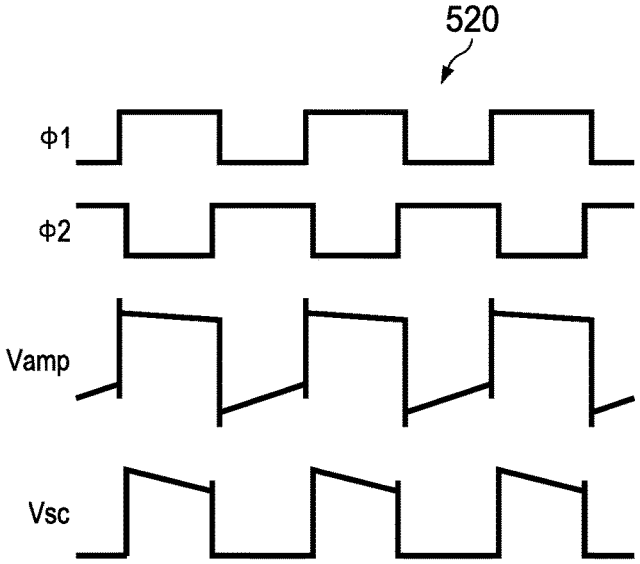
FIG. 5B shows a graph of signal waveforms for the LDO circuit of FIG. 5A in accordance with various examples.

FIG. 5B shows a graph 520 of signal waveforms for the LDO circuit 500 of FIG. 5A in accordance with various examples. More specifically, non-overlapping waveforms for ϕ1 and ϕ2 are represented as a function of time. Also, Vamp and Vsc are represented as a function of time. As shown, Vamp and Vsc are high when ϕ1 is high, and are low otherwise. Also, the waveform for Vamp shows the effect of Camp on Vamp (a gradual discharge during Vamp high intervals). Meanwhile, the waveform for Vsc shows the effect of Csc on Vsc (a gradual discharge during Vsc high intervals).

Figure 6:
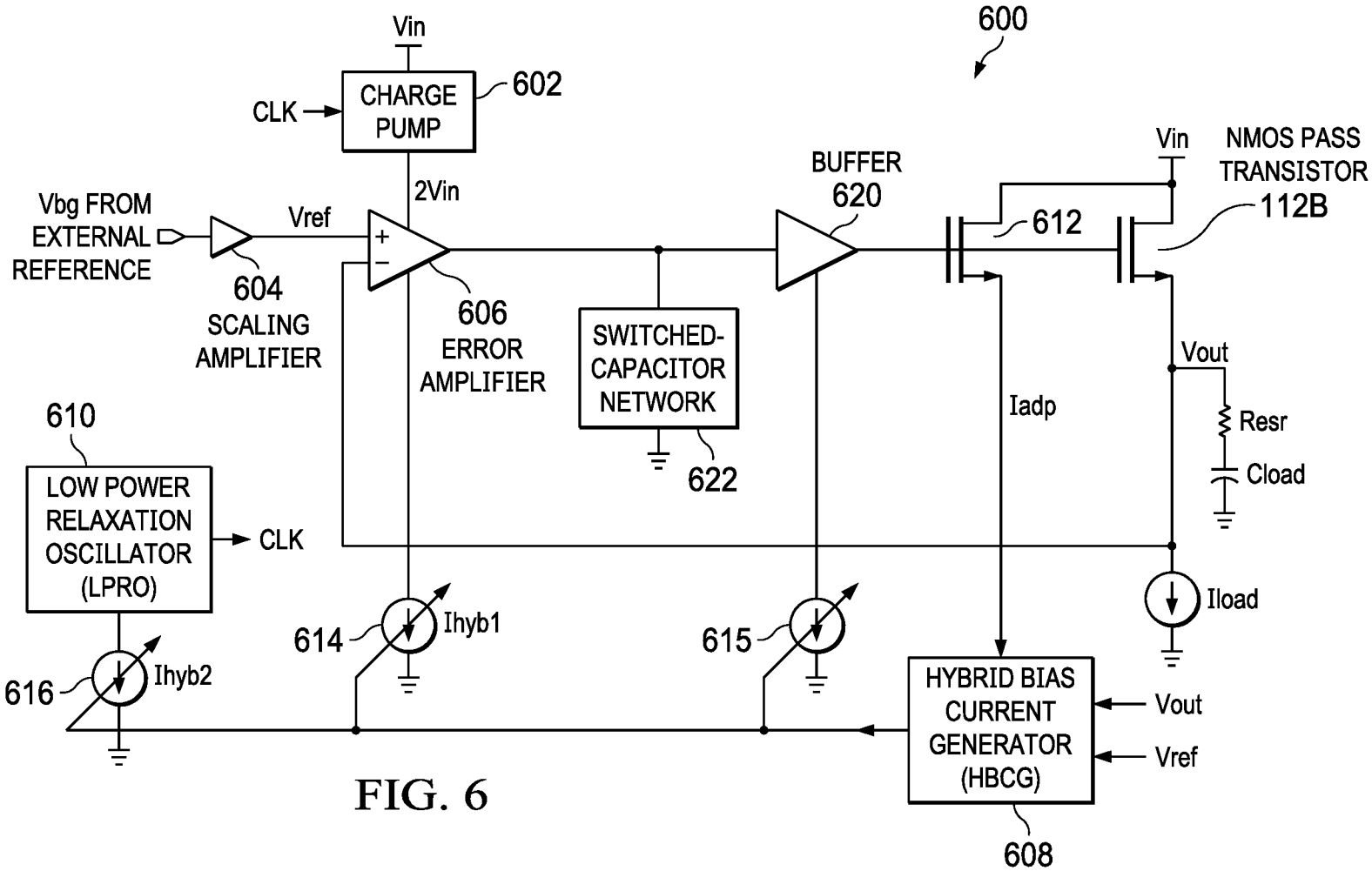
FIG. 6 shows a schematic diagram of another LDO circuit with an NMOS pass transistor in accordance with various examples.

FIG. 6 shows a schematic diagram of another LDO circuit 600 with an NMOS pass transistor 112B in accordance with various examples. As shown, the LDO circuit 600 comprises an error amplifier 606 that drives the NMOS pass transistor 112B based on the error between a reference signal (Vref) and a feedback signal input to the error amplifier. In some examples, as is represented in FIG. 6, a buffer 620 is placed between the output of the error amplifier 606 and the control terminal of the NMOS pass transistor 112B. Also, a switched-capacitor network 622 is positioned between the output of the error amplifier 606 and the buffer 620. In some examples, the error amplifier 606, the buffer 620, and the switched-capacitor network 622 are the same components as the error amplifier 106B, the buffer 110B, and the switched-capacitor network 108B represented in FIG. 2B.

In FIG. 6, the LDO circuit 600 includes other components, including a scaling amplifier to scale an input voltage (Vbg) to Vref, and a charge pump 602 to double a voltage (Vin) such that 2*Vin is used to power the error amplifier 606. In FIG. 6, the LDO circuit 600 also includes a first current source 614 that powers the error amplifier 606, and a second current source 615 that powers the buffer 620. In addition, the LDO circuit 600 includes a low power relaxation oscillator (LPRO) 610 and a hybrid bias current generator (HBCG) 608. As shown, HBCG 608 generates current based on Vref, Vout, and Iload (e.g., a mirrored version of Iload). In operations, HBCG 608 changes the bias current into LPRO 610 as a function of the load current, Iload. As Iload increases, the bias current to LPRO 610 also increases. This increase in bias current then increases the clock frequency which ensures that the switched-capacitor zero tracks the output pole Iload increases.

Figure 8:
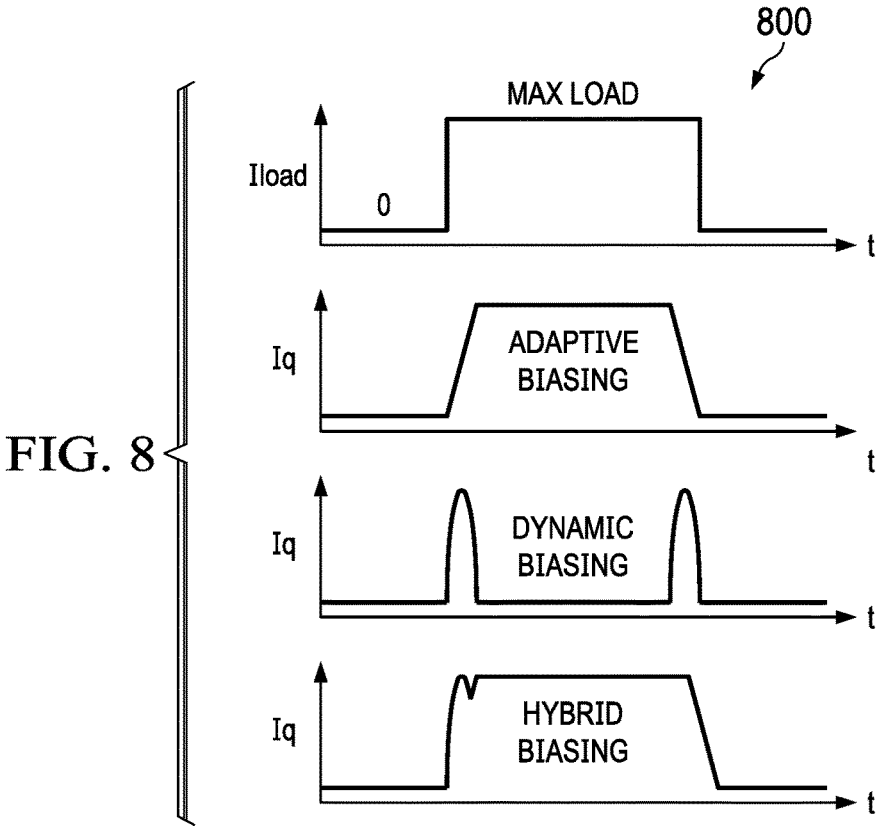
FIG. 8 shows a graph of load current for a HBCG scheme as a function of time for different biasing scheme in accordance with various examples.

In at least some examples, the LDO circuit 600 has quiescent current (lq) of 1.24 μA. Compared to other PMOS pass device LDO circuits, the NMOS pass device inside LDO circuit 600 provides faster transient response, low output impedance even at light load currents, and lower gate parasitic capacitance due to its smaller physical size. In at least some examples, the error amplifier 606 is a bias-current scalable, two-stage error amplifier with an on-demand pull-up (PU)/pull-down (PD) buffer that drives the NMOS pass transistor 112B. The HBCG 608 scales the bias current dynamically during load transients and adaptively based on Iload, With HBCG 608, faster lq scaling is possible, which improves both loop bandwidth and slew rate of the error amplifier 606 even at light Iload values. FIG. 8 shows a graph 800 comparing the bias-current profile from the HBCG scheme represented in FIG. 6 with other current scaling techniques.

Low dropout voltage for the LDO circuit 600 is ensured by powering the error amplifier 606 with a charge pump 602 that doubles Vin. In some examples, a native NMOS pass transistor is used with the LDO circuit 600 instead of a regular NMOS pass transistor. In such case, the charge pump 602 is not used. In different examples, considerations such as mask cost, device footprint, and drain-to-source leakage current levels are used to select whether to use a regular NMOS pass transistor with a charge pump 602 as represented in FIG. 6 or a native NMOS pass transistor.

In some examples, the charge pump 602 is a dynamic frequency charge pump, and the error amplifier 606 is a hybrid-mode biased error amplifier, which acts as a variable load. For the LDO circuit 600 of FIG. 6, the LPRO 610 generates the charge pump clock signal with a clock frequency proportional to Iload. With switched-capacitor pole tracking (SCPT) compensation, the LDO closed-loop circuit 600 meets with a threshold stability across load conditions. In some examples, a phase margin of 30 degrees or higher is considered to be sufficient for stability.

In some examples, the LDO circuit 600 provides a maximum Iload of 150 mA while using a low-ESR 1 μF load capacitor (Cload). In one example, the scaling amplifier 604 shifts an external reference voltage of 0.8 V to an internal reference (Vref) equal to the required output voltage (Vout) and the error amplifier 606 is operated in a unity gain configuration.

Figure 7:
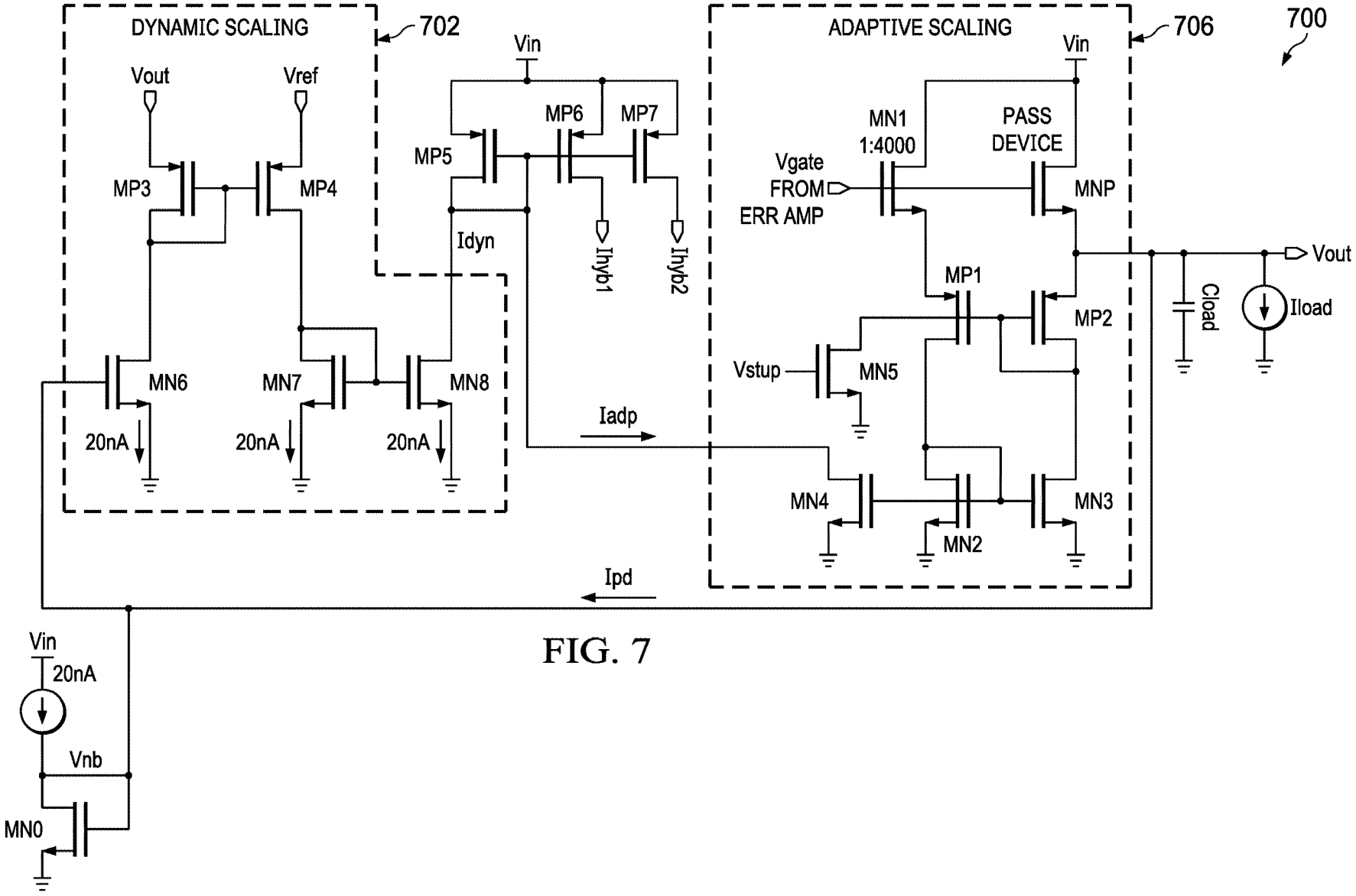
FIG. 7 shows a schematic diagram of a hybrid bias current generator (HBCG) circuit for use in an LDO circuit with a switched-capacitor network in accordance with various examples.

FIG. 7 shows a schematic diagram of an HBCG circuit 700 for use in an LDO circuit with a switched-capacitor network in accordance with various examples. The HBCG circuit 700 of FIG. 7 is an example of the HBCG 608 in FIG. 6. As noted earlier, HBCG circuits such as the HBCG circuit 700 are responsible for both adaptive current scaling and dynamic current scaling, Load-dependent adaptive current is obtained by MN1, which mirrors a fraction (e.g., 1:4000) of the pass transistor (labeled "MNP") current. In order to ensure accurate mirroring, the source voltage of MN1 needs to be equal to Vout. This is achieved using the current mirrors MN2 and MN3 along with MP1 and MP2.

As Iload increases, drain-source current in MN1 also increases and current mirror pair MN2 and MN3 ensures equal current flow in both branches, forcing MP1 and MP2 to have the same gate-source voltage (Vgs) As the gate terminal is common to both MP1 and MP2, the source voltage of MP2 which is Vout is copied onto the source terminals of MP1 and MN1, MN4 mirrors the final adaptive current (ladp).

At zero Iload, MN1 is in deep subthreshold region and does not conduct any current. Effectively, the entire adaptive scaling circuit 706 does not contribute to the overall lq of the LDO, which is advantageous for reducing lq in LDOs, At startup, the gate voltage of MN2 and MN3 is pulled down to ground by the diode connected MN2. However, the common gate voltage of both MP1 and MP2 is indeterministic at startup and if it is close to VDD, the entire adaptive scaling circuit may remain in an OFF state (due to MP1 and MP2 being in an off state) even when Iload increases. In order to avoid this faulty case, the gate nodes for MP1 and MP2 are discharged to ground by MN5 using a short pulse (Vstup) at startup. In some examples, dynamic current scaling is based on virtual ground error voltage ($\Delta V = Vout - Vref$), which is obtained by monitoring the input voltages of the error amplifier (e.g., the error amplifier 606), In some examples, detection is achieved by utilizing PMOS common-gate differential pair with source terminals as inputs.

In the dynamic scaling circuit 702 of FIG. 7, the input pair consists of matched MP3 and MP4 transistors operating in subthreshold region. When the LDO circuit is in steady state, the error voltage $\Delta V \approx 0$, and the 20 nA bias current is mirrored to generate Idyn (e.g., 20 nA) through MP3 and MP4 and MN7 and MN8 current mirrors. However, during an output undershoot event ($\Delta V < 0$) caused due sudden step-up of Iload, the undershoot in Vout produces an increased gate drive ($\Delta Vsg$) for MP4 through diode connected MP3. Effectively, current through MP4 which is biased in subthreshold region increases exponentially and is mirrored by MN7 and MN8 resulting in an exponential increase in Idyn. Due to the absence of high-impedance paths, this scheme provides instantaneous current scaling during load transients. The adaptive current (ladp) is added to dynamic current (Idyn) and then mirrored by MP5-MP6, MP7 to generate the bias currents of the error amplifier (Ihyb1) and oscillator (Ihyb2).

Figure 9:
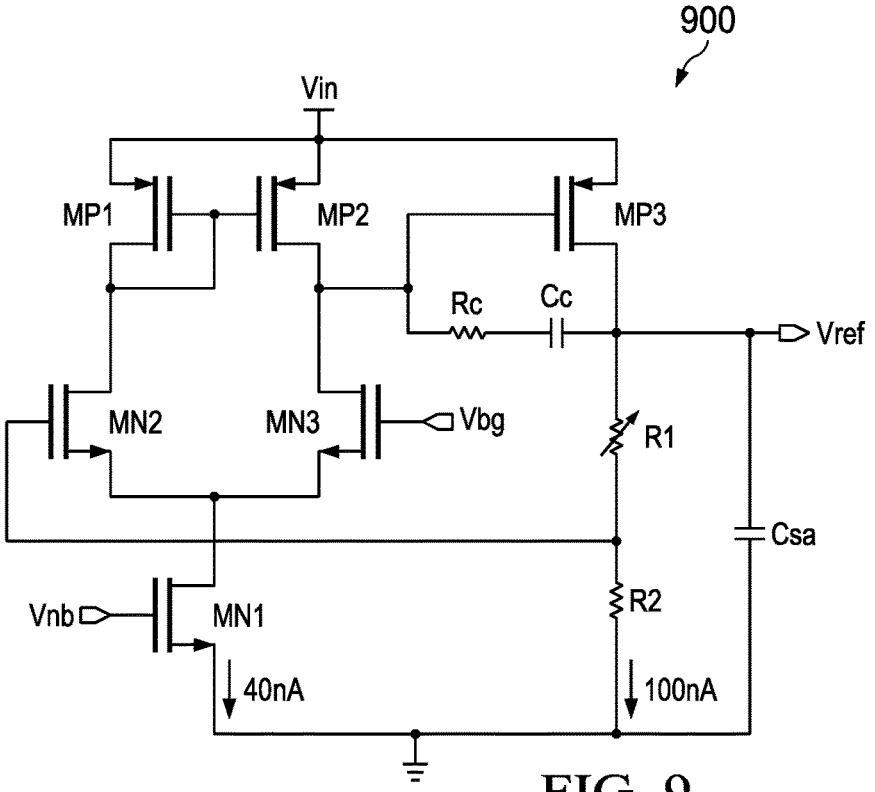
FIG. 9 shows a schematic diagram of a scaling amplifier circuit for use in an LDO circuit with a switched-capacitor network in accordance with various examples.

FIG. 9 shows a schematic diagram of a scaling amplifier circuit 900 for use in an LDO circuit with a switched-capacitor network in accordance with various examples. The scaling amplifier circuit 900 is an example of the scaling amplifier 604 in FIG. 6. Scaling amplifiers such as the scaling amplifier circuit 900 are used, in some examples, to generate the scaled reference voltage Vref from an external reference Vbg. As represented in FIG. 9, the scaling amplifier circuit 900 includes a two-stage design with a differential amplifier as its first stage and a PMOS common source amplifier as its second stage driving an output capacitor (Csa). An example value for Csa is 2.0 pF. To keep the current branches to minimum, the bias voltage (Vnb) for the tail current source (MN1 in FIG. 9) is derived from MN0 of the HBCG circuit 700 in FIG. 7 and both devices are closely matched in layout to minimize mismatch. In the example of FIG. 9, the scaling amplifier circuit 900 is stabilized using Miller capacitance Cc and resistor Rc, which operate to cancel the right half-plane zero associated with Miller compensation. A digitally-programmable resistor divider with fixed R2 and variable R1 is used to generate Vref corresponding to the LDO output voltage range of 1-3 V.

Figure 10:
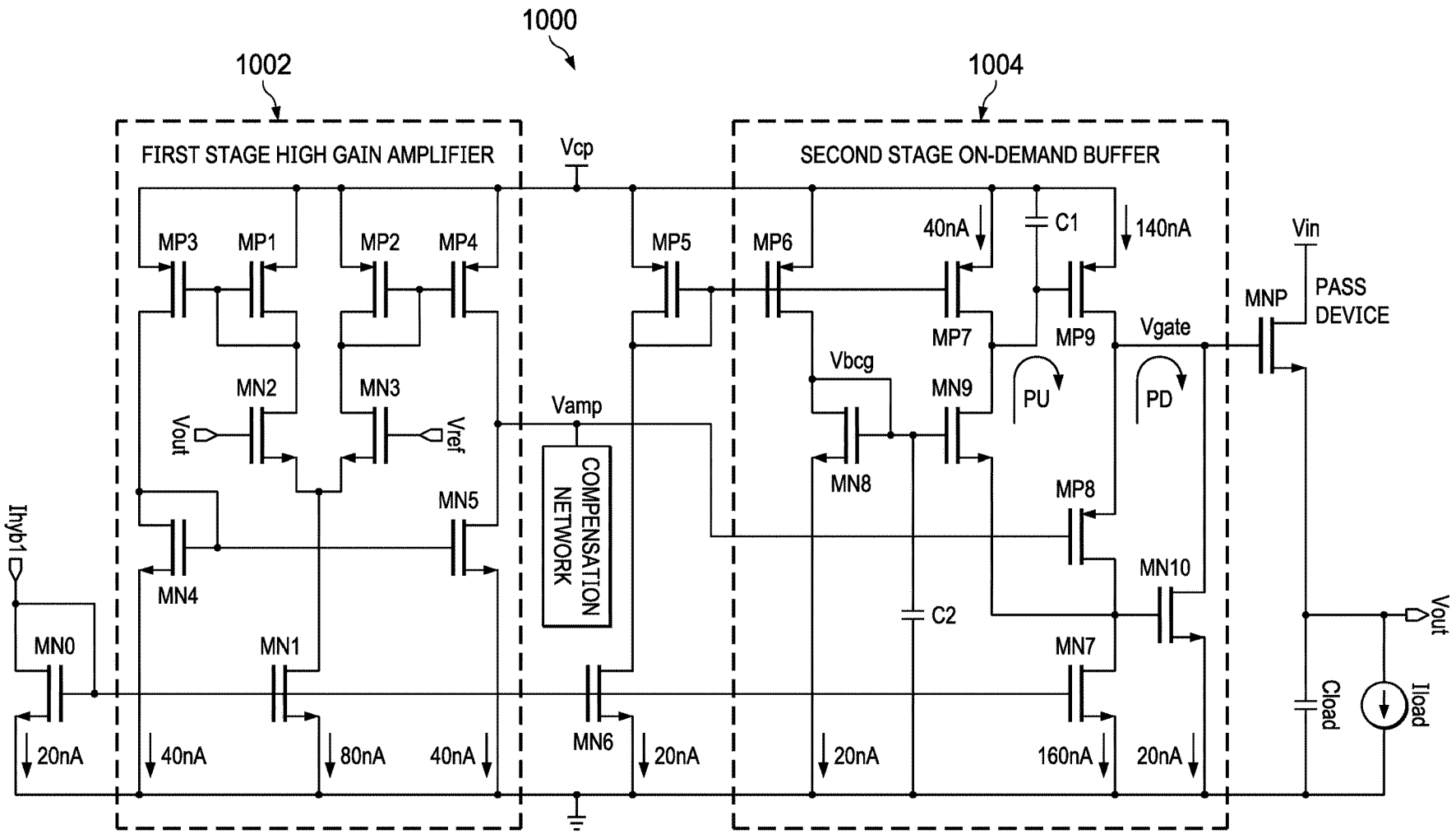
FIG. 10 shows a schematic diagram of a two-stage error amplifier for use in an LDO circuit with a switched-capacitor network in accordance with various examples.

FIG. 10 shows a schematic diagram of a two-stage error amplifier 1000 for use in an LDO circuit with a switched-capacitor network in accordance with various examples. The two-stage error amplifier 1000 is an example of the error amplifier 606 in FIG. 6. In at least some examples, a charge pump (voltage doubler) provides the supply voltage to the two-stage error amplifier 1000, which corresponds to a bias-current scalable error amplifier. Due to this 2*Vin voltage supply, which can go as high as 6 V when Vin=3.3 V, the error amplifier 1000 uses 7 V devices instead of 3.3 V devices. In such case, the pass transistor also is a 7 V regular NMOS. In some examples, the bias current (Ihyb1) for the error amplifier 1000 is generated by an HBCG circuit such as the HBCG circuit 700 of FIG. 7. The first stage 1002 of the error amplifier 1000 includes a symmetrical operational transconductance amplifier (OTA). Small-signal analysis of the two-stage error amplifier 1000 shows that the gain of the amplifier (Gamp) and its 3 dB pole location (Pamp) are given by:

$$Gamp \cong gm_{MN2} * (r_{ds,MP4} \| r_{ds,MN5}), \text{ and} \quad \text{Equation (1)}$$

$$Pamp \cong \frac{1}{2\pi(r_{ds,MP_4} \| r_{ds,MN_5})Camp}, \quad \text{Equation (2)}$$

where Camp is the effective load capacitance at the output of the first stage. With increase in Ihyb1, although output impedance ($r_{ds,MP4} \| r_{ds,MN5}$) drops, increase in $gm_{MN2}$ compensates for this drop, thereby maintaining a dc gain higher than 50 dB for all possible Ihyb1 values. However, its 3 dB bandwidth increases proportionally with Ihyb1 as Pamp moves to a higher frequency due to the reduction in output impedance.

A second stage 1004 of the two-stage error amplifier 1000 is a second-stage bias-current scalable dual-loop CMOS voltage buffer that is placed in between the first stage 1002 and the pass transistor in order to increase the slew rate at the gate of the pass transistor and improve the load transient response. In contrast to a voltage buffer with only on demand pull-up (sometimes abbreviated as PU in the equations presented herein) capability, and to super-source follower buffer with only on-demand pull-down (sometimes abbreviated as PD in the equations presented herein), the proposed buffer achieves on-demand fast pull-up as well as fast pull-down capability improving the transient response to (load step-up and step-down, respectively.

At the core, the buffer consists of a PMOS source follower (MP8). For simplicity, the pull-up and pull-down loops are analyzed separately. Instead of a regular source follower biased with a fixed current source, dynamic fast pull-up is achieved through a negative feedback loop realized using common-gate stage (MN9 and MP7) and common source stage (MP9) which constitute a cascoded flipped-voltage follower. This feedback loop not only provides the required on-demand sourcing current to charge the gate of pass transistor during a load step-up, but also reduces the small-signal output impedance of the buffer. In at least some examples, the effective pull-up output impedance is calculated as:

$$r_{0,PU} = \frac{\Delta v_x}{\Delta y_x} = \frac{\Delta v_x}{\Delta i1 - \Delta i2}. \quad \text{Equation (3)}$$

The small-signal current +Δi1 is translated to −Δi1 onto the CG stage MN9, drops across the equivalent impedance of ($r_{ds,MP7} \| r_{ds,MN9}$) and is converted to voltage $\Delta v_{GP}$. This $\Delta v_{GP}$ is converted to Δi2 using MP9 and is given by:

$$\Delta i2 - gm_{MP9} * \Delta v_{GP} \cong gm_{MP9} * -\Delta i1 * (r_{ds,MP7} \| r_{ds,MP9}). \quad \text{Equation (4)}$$

Using equations 3 and 4, the following relationship is obtained:

$$r_{0,PU} \cong \frac{\Delta v_x}{[1 + gm_{MP9}(r_{ds,MP_7} \| r_{ds,MP_9})]\Delta i1}. \quad \text{Equation (5)}$$

Substituting $\Delta i1 = gm_{MP8} * \Delta v_x$, the following relationship is obtained:

$$r_{0,PU} \cong \frac{\Delta v_x}{gm_{MP_8} * gm_{MP_9} * (r_{ds,MP_7} \| r_{ds,MP_9})}. \quad \text{Equation (6)}$$

Thus, the effective output impedance is reduced by a factor of loop gain given by $A_{PU} = gm_{MP9} * (r_{ds,MP7} \| r_{ds,MP9})$ in comparison to a simple source follower in which case it would have been just ($1/gm_{MP8}$), thereby pushing the parasitic pole at the gate of pass transistor (Pgate) to higher frequency. Similar analysis can be done for the fast pull-down loop which is a super-source follower formed by MP8, MN7, and MN10, where the effective output impedance is given by:

$$r_{0,PD} = \frac{\Delta v_x}{\Delta i_x} = \frac{\Delta v_x}{\Delta i1 + \Delta i2}. \quad \text{Equation (7)}$$

The small signal current Δi1 drops across the effective impedance ($r_{ds,MP8} \| r_{ds,MP7}$) producing voltage $\Delta v_{GN}$, which is translated to Δi1 given by:

$$\Delta i2 = gm_{MN10} * \Delta v_{GN} \cong gm_{MN10} * \Delta i1 * (r_{ds,MP8} \| r_{ds,MN7}). \quad \text{Equation (8)}$$

Using Equations 7 and 8 and substituting $\Delta i1 = gm_{MP8} * \Delta v_x$, it follows that:

$$r_{0,PD} \cong \frac{1}{gm_{MP_8} * gm_{MN_{10}} * (r_{ds,MP_8} \| r_{ds,MN_7})}, \quad \text{Equation (9)}$$

reducing the effective output impedance by a factor of loop gain given by $A_{PD} = gm_{MN10} * (r_{ds,MP8} \| r_{ds,MP7})$. At steady state, the gate voltage of MN10 is held at a threshold voltage lower than Vbcg and it conducts approximately 20 nA of drain-source current for the example given in FIG. 7. In some examples, the pull-up loop has three different poles, including an MN9 drain pole given by $$P_{PU1} \cong \frac{1}{(r_{ds,MP_7} \| r_{ds,MN_9}) * C1};$$

an MNP gate pole given by $$Pgate\ or\ P_{PU2} = \frac{1}{(r_{0,PU}) * C_{G,MNP}};$$

and an MP8 drain pole given by $$P_{PU3} \cong \frac{1}{\left(r_{ds,MP_8} \| r_{ds,MN_7} \| 1/gm_{MP_9}\right) * Cpar}.$$

Since $r_{0,PU}$ is reduced by using the cascaded flipped-voltage follower approach, $P_{PU2}$ is pushed to a higher frequency even at light bias-current conditions. The effective impedance looking-in at the drain of MP8 is reduced due to the low impedance of MN9 ($1/gm_{MN9}$). This accompanied with the low equivalent parasitic capacitance (Cpar) at this node, ensure that $P_{PU3}$ is at a much higher frequency. Therefore, the entire pull-up loop is stabilized using C1 (e.g., with a value of 1 pF), which is connected to the gate of MP9 making $P_{PU1}$ the dominant pole. $P_{PU2}$ and $P_{PU3}$ remain beyond the pull-up loop unity-gain bandwidth (UGB) even at light bias-current condition providing a minimum phase margin of 45° across all load conditions. C2 (e.g., with a value of 1 pF) acts as a glitch filter capacitor to keep the gate voltage of MN9 constant during large signal variations at its drain and source nodes. The pull-down loop gain is weak compared to pull-up loop in normal operation and is dominant only during Iload stepdown. It is naturally stabilized with the gate capacitance of MNP. As the variable biasing current Ihyb1 increases with Iload, the output impedance of the buffer is reduced further and pushes Pgate to higher frequency.

In some examples, the two-stage error amplifier 1000 is powered by a cross-coupled voltage doubler charge-pump in order to maintain a low dropout voltage for the LDO. However, variable Ihyb1 (which biases the two-stage error amplifier 1000), modulates the current drawn from the charge pump with Iload and ultimately, changing its 2× output voltage. In order to maintain a constant output voltage of ≈2*Vin, the charge pump clock frequency (Fclk) is modulated to counteract its load current variations. Thus, in some examples, a current tunable relaxation oscillator such as LPRO 610 in FIG. 6 is used to generate the charge pump control clocks.

Figure 11:
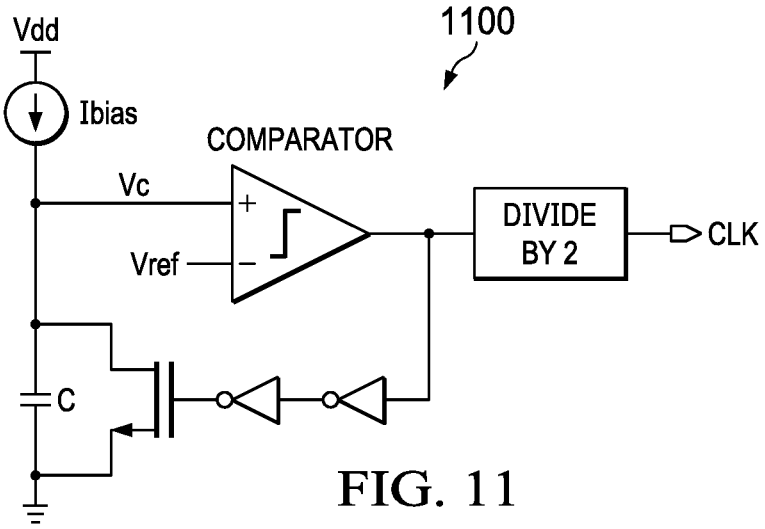
FIG. 11 shows a schematic diagram of a relaxation oscillator for use in an LDO circuit with a switched-capacitor network in accordance with various examples.

FIG. 11 shows a graph of schematic diagram of a low power relaxation oscillator (LPRO) 1100 for use in an LDO circuit with a switched-capacitor network in accordance with various examples. In some examples, the relaxation oscillator 1100 is. For the relaxation oscillator 1100, a bias current (Ibias) charges the capacitor (C) until its voltage (Vc) exceeds a reference voltage (Vref) at which the comparator momentarily changes its output state to logic high to discharge the capacitor. As soon as the capacitor is discharged, the comparator outputs a logic low and the same sequence repeats periodically to produce an output clock. The approximate output clock frequency (Fclk) of this oscillator is given by:

$$Fclk = \frac{Ibias}{2C * Vref} \qquad \text{Equation (10)}$$

revealing that it is directly proportional to bias current.

Figure 12:
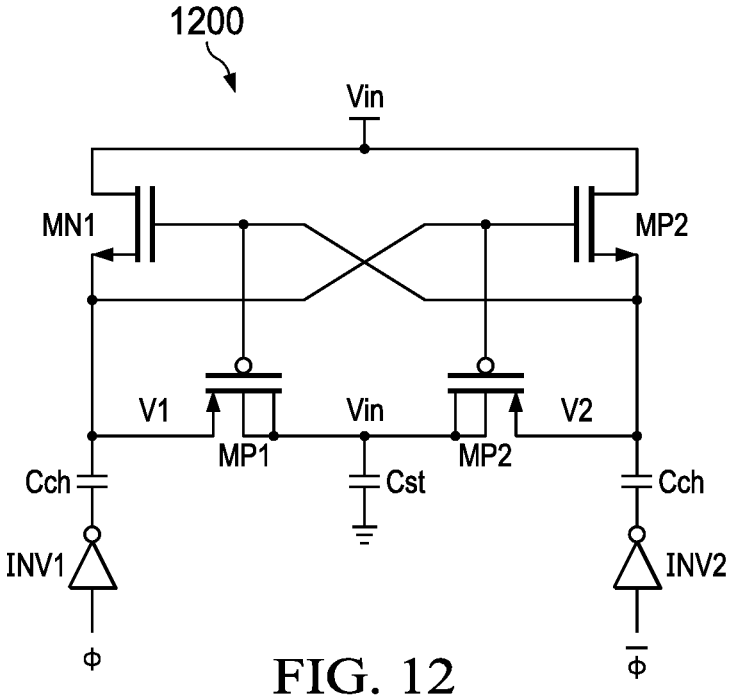
FIG. 12 shows a schematic diagram of a charge pump voltage doubler for use in an LDO circuit with a switched-capacitor network in accordance with various examples.

FIG. 12 shows a graph of schematic diagram of a charge pump voltage doubler 1300 for use in an LDO circuit with a switched-capacitor network in accordance with various examples. The charge pump voltage doubler 1300 uses non-overlapping clock phases and two inverters (INV1 and INV2) to drive two charging capacitors (Cch). Due to the combined effect of NMOS switches MN1 and MN2 along with the inverters, the node voltages V1 and V2 swing between Vin and 2*Vin. This charge is then transferred to storage capacitor Cst in every clock phase and maintains the output voltage of the charge pump voltage doubler 1300 close to 2*Vin. In some examples, both Cch and Cst are sized slightly higher than 8 pF each.

In some examples, the stability of an LDO circuit such as the LDO circuit 600 (or other LDO circuit disclosed herein) is determined by the location of three distinctive poles: the LDO output pole Pout, amplifier output pole Pamp, and the pass transistor gate pole Pgate. Since the NMOS pass transistor acts like a source follower, the output impedance of the LDO is given by:

$$Rout \cong \frac{1}{gm_{MNP}} \| Rload, \qquad \text{Equation (11)}$$

where Rload is the load current equivalent resistance connected at the output of the LDO circuit 600. Thus, Pout is given by:

$$Pout \cong \frac{1}{2\pi\left(\frac{1}{gm_{MNP}} \| Rload\right) Cload}. \qquad \text{Equation (12)}$$

Pamp is given in Equation 2, Pgate is obtained by using Equation 6, and parasitic pass transistor gate capacitance ligate as:

$$Pgate \cong \frac{1}{2\pi\left(gm_{MP_8} * gm_{MP_9}\right)(r_{ds,MP_7} \| r_{ds,MN_9}) Cgate}. \qquad \text{Equation (13)}$$

Pout changes with Iload and due to adaptive biasing, Pamp, Pgate, and the loop UGB also change with Iload. The graph 300 of FIG. 3 shows an example of the movement of these poles with Iload. In some examples, the buffer used with the LDO circuit 600 design ensures that Pgate is always beyond the loop UGB and hence does not influence the overall loop stability. At zero to light load currents (Iload1), Pout is at a very low frequency (~1 Hz) and is very close to Pamp (~10 Hz). As Iload increases to about 1 mA (Iload2), Pout drastically shifts to higher frequency, however, due to very minor increment in bias current, Pamp moves slightly. Hereafter, as the Iload increases, Pout shifts to higher frequency eventually moving outside the UGB for close to maximum Iload conditions (Iload3). Pamp also shifts to higher frequency due to proportional increase in bias current thereby increasing the loop UGB. Closely spaced low-frequency poles at light Iload and constantly frequency shifting poles with increase in Iload result in challenging considerations for the compensation scheme.

In an LDO circuit such as the LDO circuit 600 (or other LDO circuit disclosed herein), a Pout tracking zero is introduced to provide a phase boost and ensure stability. A zero can be introduced in the loop by using a switched-capacitor network (e.g., the switched-capacitor network 622). Using a switched-capacitor network uses less space than other frequency-dependent resistance device options. In some examples, the same oscillator clock is used to control Rsc with its effective value given by:

$$Rsc = \frac{1}{Fclk * Csc}, \quad \text{Equation (14)}$$

where Csc is the capacitance used to implement Rsc and the switched-capacitor pole tracking zero (ZSC) is given by $$Zsc = \frac{Fclk * Csc}{2\pi * Camp}. \quad \text{Equation (15)}$$

However, from Equation 10, Fclk∝Ihyb1 and due to adaptive biasing we have Ihyb1∝Iload. Therefore, from Equation 17, it follow that:

$$Zsc \propto Iload. \quad \text{Equation (16)}$$

Thus, Zsc tracks Pout, which is proportional to Iload, and provides a phase boost for the entire range of load currents. In some examples, a small capacitance Csc=0.25 pF is used to implement Rsc, providing an area-efficient solution. In at least some examples, non-overlapping clocks control the switches used for the switched-capacitor network of an LDO.

Figure 14:
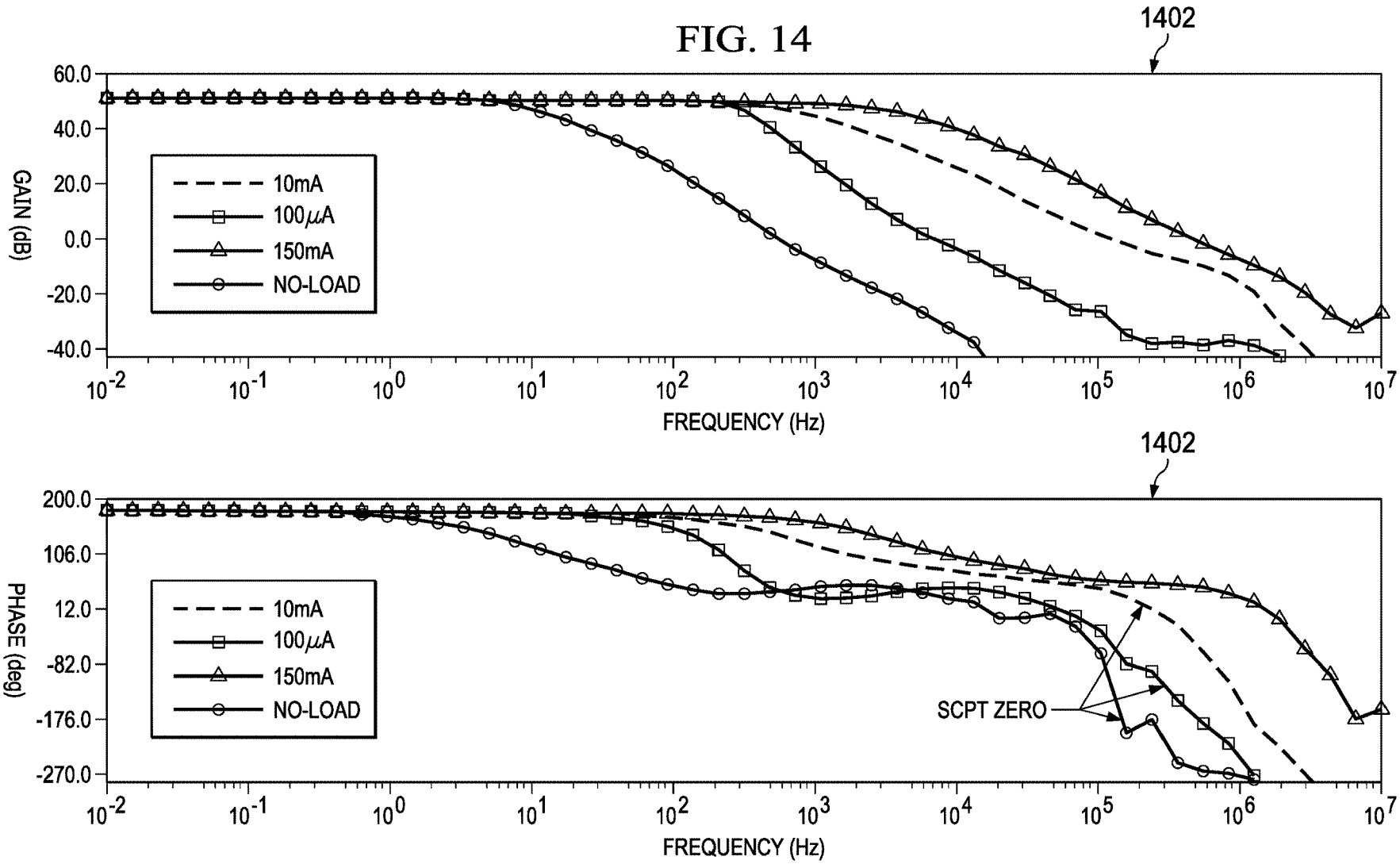
FIG. 14 shows graphs representing simulated loop gain and phase response for an LDO closed-loop circuit with a switched-capacitor network in accordance with various examples.

FIG. 14 shows graphs 1402 and 1404 representing simulated loop gain and phase response for an LDO circuit with a switched-capacitor network in accordance with various examples. To generate the graphs 1402 and 1404, periodic steady state (PSS) followed by periodic AC (PAC) simulation for different load current values for a load capacitance of 1 μF were used. The impact of hybrid biasing can be seen as the UGB shifts with load current. The phase margin is always above 30° and demonstrates the effectiveness of the SCPT compensation.

In some examples, an LDO circuit such as the LDO circuit 600 (or other LDO circuit described herein) ensures that the LDO is stable even for increments in load capacitance up to 47 μF. The zero introduced by SCPT compensation also increases the UGB of the loop thereby improving its transient response. In some examples, the clock frequency is always at least 50 times the loop UGB (Fclk≥50*UGB) for all load current conditions. Therefore, any pole (Ppar) formed due to Rsc and net parasitic capacitance (Cpar) attached to it, given by:

$$Ppar = \frac{1}{Rz * Cpar} = \frac{Fclk * Csc}{Cpar}, \quad \text{Equation (17)}$$

will be beyond the loop UGB and will not affect the stability of the LDO closed-loop.

Figure 13:
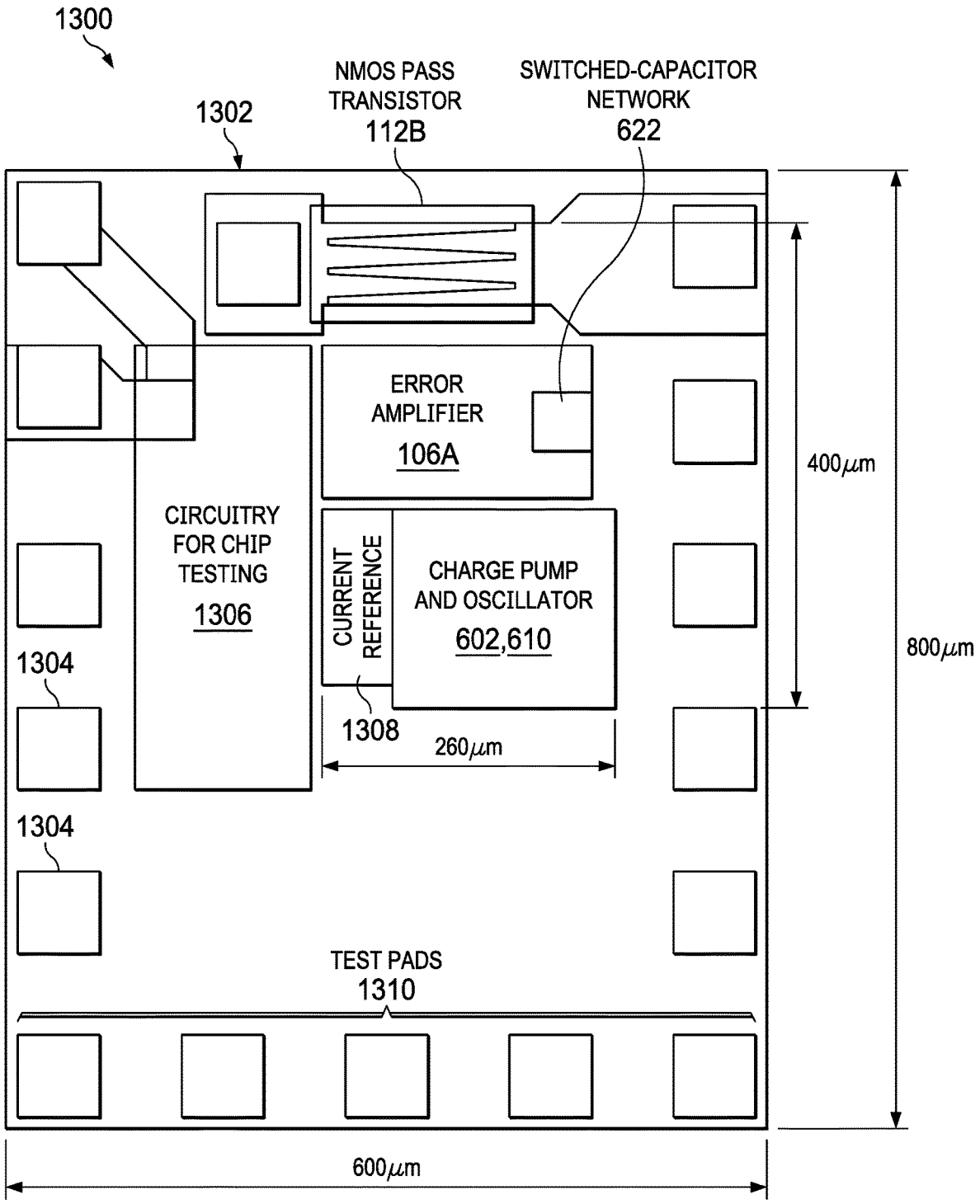
FIG. 13 shows a die micrograph with components of an LDO circuit with a switched-capacitor network in accordance with various examples.

FIG. 13 shows a die micrograph 1300 with components of an LDO circuit with a switched-capacitor network in accordance with various examples. As shown, the LDO circuit corresponding to the die micrograph 1300 includes the NMOS pass transistor 112B, the error amplifier 106A, the switched-capacitor network 622, the charge pump 602, the oscillator 610, contact pads 1304, test pads 1310, circuitry for chip testing 1306, and a current reference 1308. The dimensions given for FIG. 13 are examples only and are not intended to limit different examples of an LDO circuit to a particular dimension. In particular, the example die micrograph 1300 shows that the switched-capacitor network 622 occupies a small portion of the LDO circuit.

In one example, the die micrograph is 1300 represents an LDO circuit (e.g., the LDO circuit 600 of FIG. 6) fabricated in a 0.25 μm single-poly four-metal CMOS process. For the die micrograph 1300, the core area is 400 μm×260 μm. Also, the LDO circuit corresponding to the die micrograph 1300 uses an external voltage reference.

In some examples, the LDO circuit corresponding to the die micrograph 1400 has a digitally programmable output voltage range of 1-3 V and a maximum output current capability of 150 mA at a dropout voltage of 240 mV. The load capacitance range is from 1 to 47 μF. A single bond wire is used to bond the output of the LDO to the package pin and impacts the DC load regulation which is 25 mV as (load increases from 0 to 150 mA.

Figure 15:
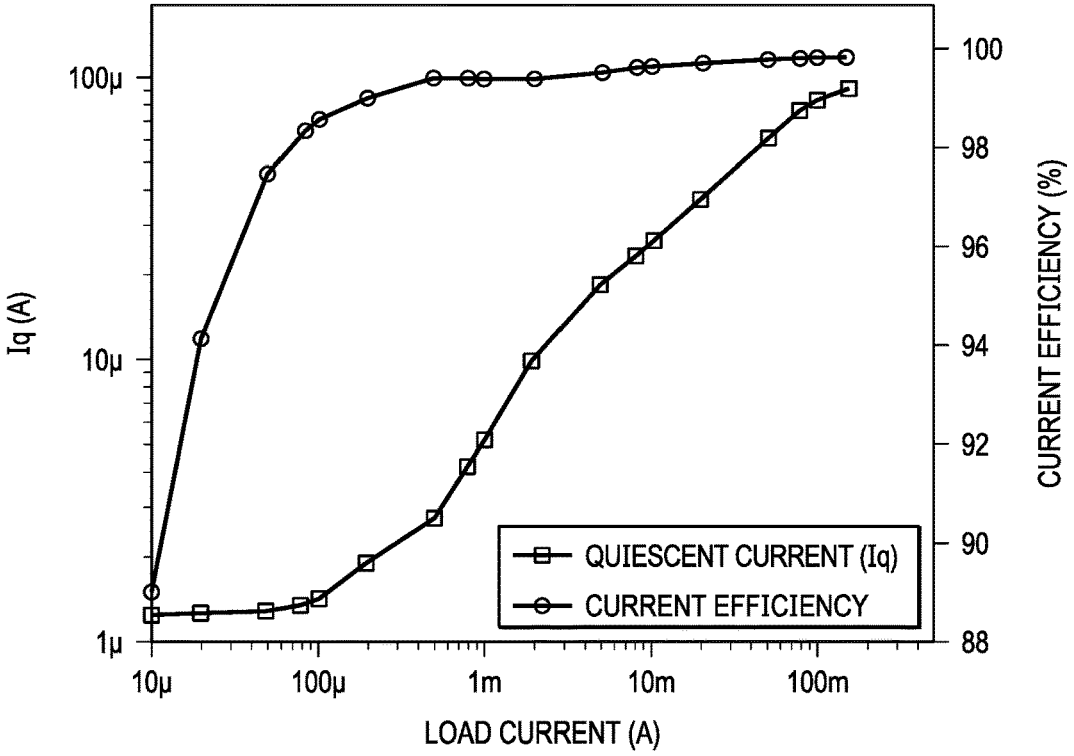
FIG. 15 shows a graph representing quiescent current and current efficiency for an LDO circuit with a switched-capacitor network in accordance with various examples.

FIG. 15 shows a graph 1500 representing quiescent current and current efficiency for an LDO circuit with a switched-capacitor network (e.g., the switched-capacitor network 622) in accordance with various examples. In some examples, the no-load Iq of the proposed LDO is only 1.24 μA. Also, Iq stays below 2 μA for Iload<200 μA and is only about 5 μA even when (load goes up to 1 mA thereby consuming very low supply current even at light load conditions. The current efficiency is above 95% even for (load as low as 50 μA and is above 99% for 200 μA and above.

Figure 16A:
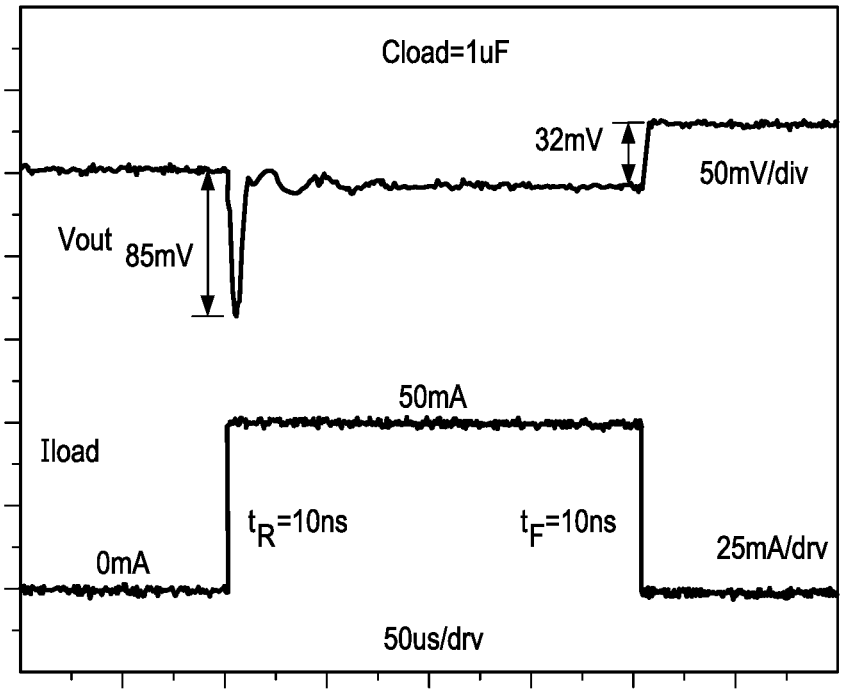
FIGS. 16A and 16B shows graphs representing a load transient response for an LDO circuit with a switched-capacitor network as function of different load steps and output capacitors in accordance with various examples.
Figure 16A:
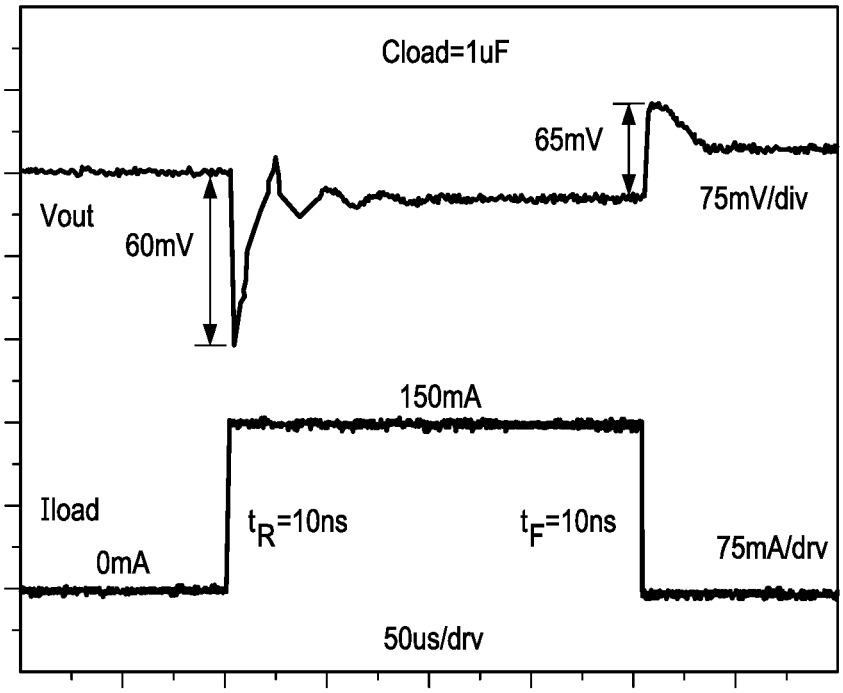
Figure 16B:
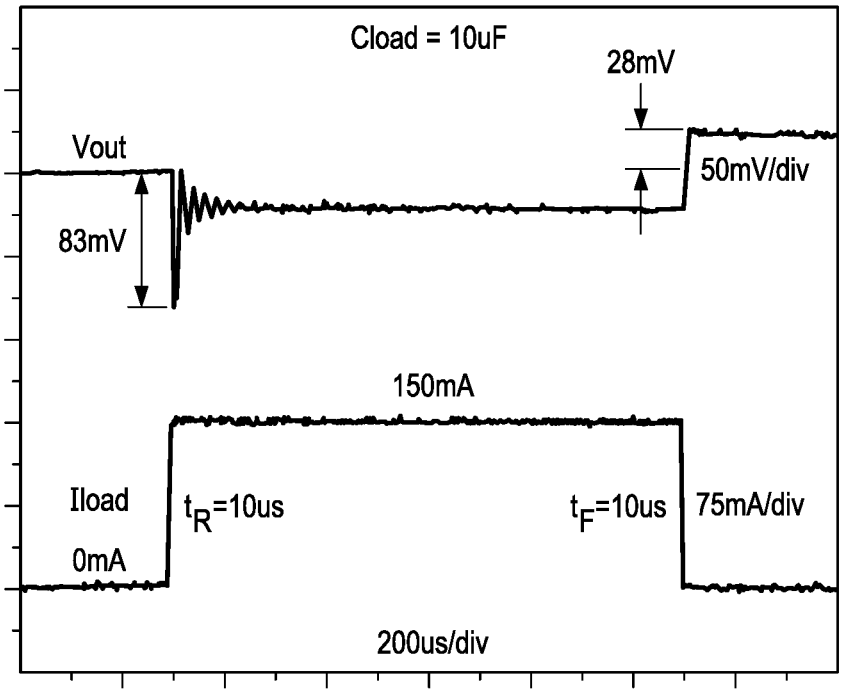
Figure 16B:
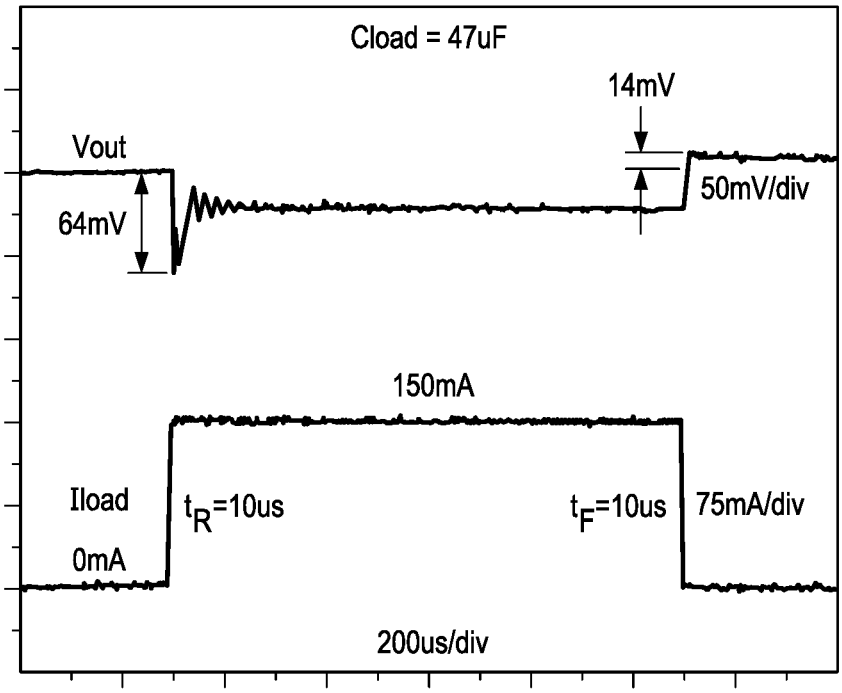

FIGS. 16A and 16B show graphs 1602, 1604, 1606, 1608 representing a load transient response for an LDO circuit with a switched-capacitor network (e.g., the switched-capacitor network 622) as function of different load steps and output capacitors in accordance with various examples. For Cload=1 μF, the undershoot and overshoot voltage for load step of 0-50 mA and vice-versa are 76 and 32 mV, respectively, and are 135 and 65 mV, respectively, for a load step of 0-150 mA. The output recovers to tolerable error limit of ±1% within 10 μs. Reduction in both undershoot and overshoot voltages is observed when Cload=10 μF and Cload=47 μF which also confirms the stability of the LDO at these load capacitance levels. In some examples, an LDO circuit such as the LDO circuit 600 of FIG. 6 uses an NMOS pass transistor, where low overshoot/undershoot and fast recovery performance of the LDO circuit is possible due to the hybrid biasing working alongside the on-demand PU/PD buffer and SCPT compensation. Although choice of NMOS pass transistor results in additional requirement of charge-pump and associated oscillator for ensuring LDO voltage, improved transient response, and effective usage of the oscillator for SCPT compensation scheme overpowers this limitation.

Figure 17:
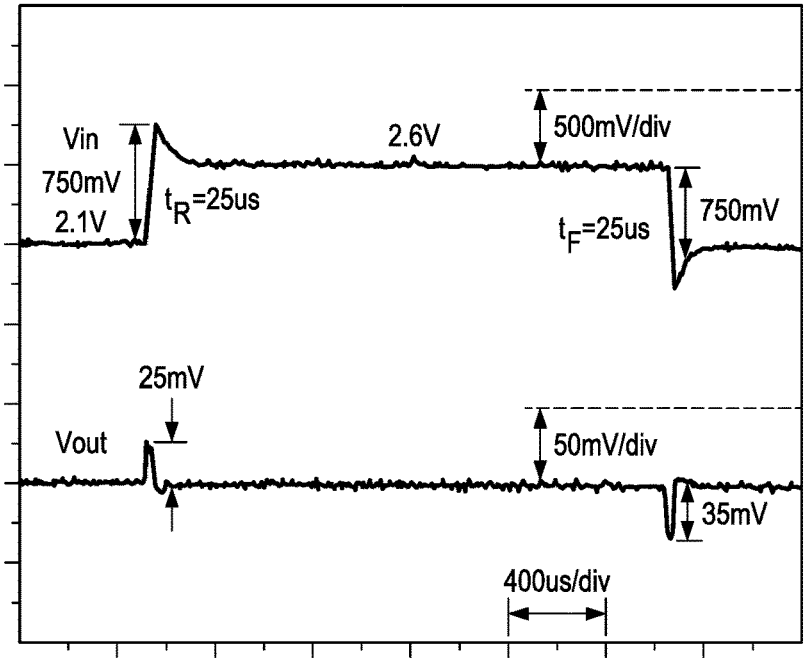
FIG. 17 shows a graph representing a line transient response for an LDO circuit with a switched-capacitor network at full-load current in accordance with various examples.

FIG. 17 shows a graph 1700 representing a line transient response for an LDO circuit with a switched-capacitor network (e.g., the switched-capacitor network 622) at full-load current in accordance with various examples. For the LDO circuit corresponding to graph 1900, a maximum load condition (e.g., Iload=150 mA) for an output voltage of 1.8 V is assumed. The initial step-up and step-down in the supply voltage is 0.75 V and results in an undershoot of 35 mV and overshoot of 25 mV. This constitutes less than 2% error for an output voltage of 1.8 V.

In at least some examples, an LDO circuit with a switched-capacitor network (e.g., the switched-capacitor network 622) has lower Iq compared to other LDO topologies, which reduces power consumption during standby and light load conditions. In some examples, the SC PT compensation described herein not only ensures stability of the LDO from zero to the entire range of load current, but also for a capacitance range of 1-47 μF without depending on an external ESR zero thereby supporting a wide output capacitor range.

Without limitation to other examples, the LDO circuit 600 has an Iq of 1.24 μA, where a hybrid bias-current scaling scheme is presented to improve the bandwidth and slew rate of the LDO for fast response to load current transients. In some examples, a charge pump (e.g., the charge pump 602 of FIG. 6 or the charge pump voltage doubler 1200 of FIG. 12) powers a bias-current scalable two-stage error amplifier (e.g., the error amplifier 606 of FIG. 6 or the two-stage error amplifier 1000 in FIG. 10) for LDO regulation. In some examples, a two-stage error amplifier includes an on-demand PU/PD buffer to ensure high slew rate at the gate of the pass transistor. Also, in some examples, an LPRO (e.g., the LPRO 610 of FIG. 6) with load current controlled clock frequency is used to generate the control clocks for the charge pump.

The SCPT compensation scheme described herein is employed for LDO stability. In some examples, SCPT compensation uses the already available variable clock frequency to achieve stability for a load capacitance range of 1-47 μF without the requirement of an ESR zero. Measurement results show that LDOs with a recovery time of less than 10 μs for zero to full-load current step-up and with higher than 95% current efficiency is possible even for a small load current of 50 μA.

Figure 18:
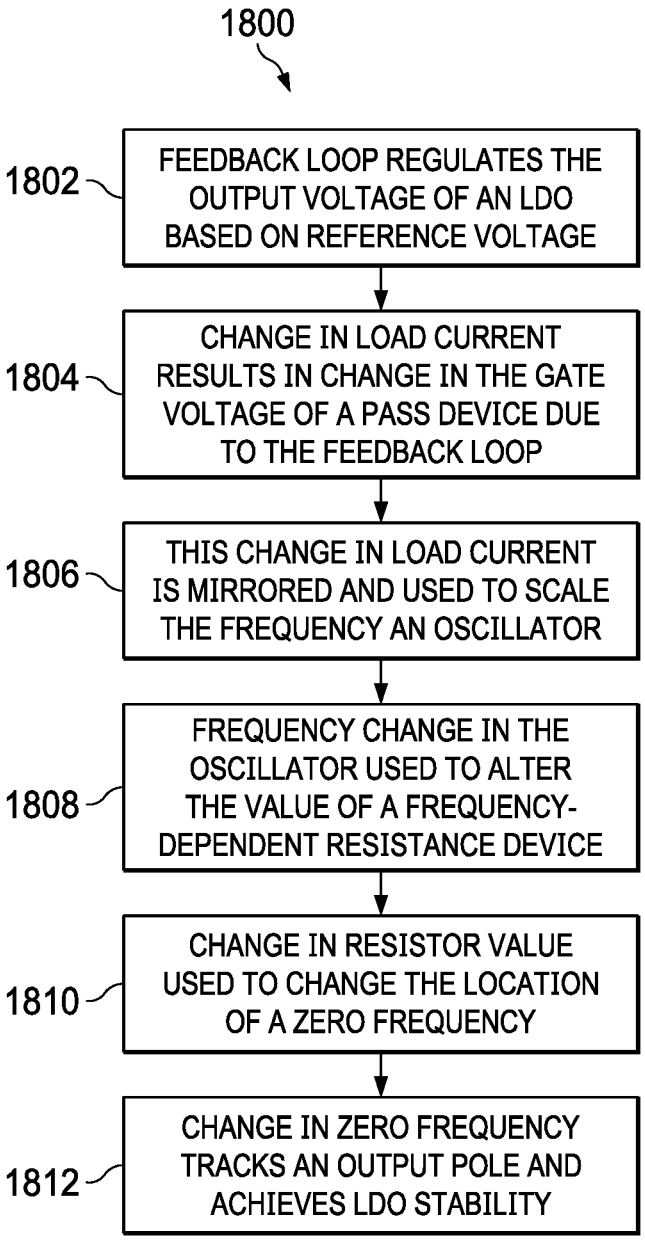
FIG. 18 shows a flowchart of an LDO closed-loop method in accordance with various examples.

FIG. 18 shows a flowchart of an LDO closed-loop method 1800 in accordance with various examples. As shown, the method 1800 comprises a feedback loop regulating the output voltage of an LDO based on a reference voltage at block 1802. At block 1804, a change in load current results in a change in the control signal for a pass device due to the feedback loop. At block 1806, the change in load current is mirrored and used to scale the frequency of an oscillator. At block 1808, the frequency change in the oscillator is used to alter the value of a frequency-dependent resistor (e.g., the switched-capacitor network 108C of FIG. 4, the switched-capacitor network 502 of FIG. 5, or the switched-capacitor network 622 of FIG. 6). At block 1810, the change in resistor value of the frequency-dependent resistor is used to change the location of a zero frequency. At block 1812, the change in zero frequency tracks the output pole and achieves LDO stability.

In some examples, the method 1800 further comprises providing a voltage source to a first current terminal of a pass transistor. Also, in some examples, the operations of block 1804 involve regulating current to a load coupled to a second current terminal of the pass transistor by adjusting gate drive signals to a control terminal of the pass transistor, wherein adjusting gate drive signals to the control terminal of the pass transistor is based on a closed-loop circuit with an error amplifier. In some examples, adjusting the gate drive signals to the control terminal of the pass transistor comprises changing a resistance value in the closed-loop circuit using a frequency-dependent resistor.

With some of the disclosed LDO topologies, a switched-capacitor network is used instead of other resistor types (e.g., metal-oxide semiconductor resistors), where the frequency of the switched-capacitor network is adjusted based on the LDO load current to modulate the resistance value. The disclosed LDO topologies provide a very low frequency zero and achieve good stability for low quiescent current designs. Also, the disclosed LDO topologies, provide good output pole tracking for robust stability. Also, the disclosed LDO topologies provide high power efficiency due to a low frequency switching being sufficient. Also, the disclosed LDO topologies have high area efficiency by using a switched-capacitor network (the capacitor can be small) instead of actual resistors. Also, the disclosed LDO topologies are robust to process, voltage, and temperature (PVT) variations due to capacitor matching. In some examples, the disclosed LDO topologies are commercialized as individual circuits (e.g., an integrated circuit or chip). In other examples, the disclosed LDO topologies are commercialized as part of a system (e.g., an integrated circuit with multiple circuits including an LDO circuit, a multi-die module, or printed circuit board with multiple components including an LDO circuit).

Certain terms have been used throughout this description and claims to refer to particular system components. As one skilled in the art will appreciate, different parties may refer to a component by different names. This document does not intend to distinguish between components that differ in name but not function. In this disclosure and claims, the terms "including" and "comprising" are used in an open-ended fashion, and thus should be interpreted to mean "including, but not limited to . . . ." The recitation "based on" is intended to mean "based at least in part on." Therefore, if X is based on Y, X may be a function of Y and any number of other factors.

The above discussion is meant to be illustrative of the principles and various embodiments of the present invention. Numerous variations and modifications will become apparent to those skilled in the art once the above disclosure is fully appreciated. For example, while use of a switched-capacitor network as described herein is beneficial due to its small footprint relative to other frequency-dependent resistance device options, it should be appreciated that other frequency-dependent resistance device, and/or variable resistors may be used in place of a switched-capacitor network. It is intended that the following claims be interpreted to embrace all such variations and modifications.

What is claimed is:

1. A system, comprising:

a low dropout regulator (LDO) circuit including:

an error amplifier having an amplifier input, a reference input, and an amplifier output;

a pass transistor having a control terminal, a first terminal and a second terminal, the control terminal coupled to the amplifier output, and the current terminal coupled to the amplifier input; and a switched-capacitor network coupled between the amplifier output and the pass transistor, the switched-capacitor network including switches and a current-controlled oscillator, and the switches having control terminals coupled to the current-controlled oscillator.

2. The system of claim 1, further comprising a current mirror circuit coupled between the first terminal and the current-controlled oscillator.

3. The system of claim 2, wherein the current-controlled oscillator is configured to: receive a current from the current mirror circuit; and provide control signals to the control terminals of the switches, the control signals having a frequency based on the current from the current mirror circuit.

4. The system of claim 2, wherein:

the switches include a first transistor and a second transistor, the switched-capacitor network includes a first capacitor having a first and second electrodes, a control terminal of the first transistor is coupled to the current-controlled oscillator, a control terminal of the second transistor is coupled to the current-controlled oscillator, a first terminal of the first transistor is coupled to the amplifier output via a second capacitor, a second terminal of the first transistor is coupled to the first electrode and to a first terminal of the second transistor, and a second terminal of the second transistor is coupled to the second electrode and to a ground terminal.

5. The system of claim 3, wherein the current-controlled oscillator is configured to provide control signals with non-overlapping phases to the control terminals of the switches.

6. The system of claim 1, further comprising a buffer between the amplifier output and the control terminal of the pass transistor.

7. The system of claim 1, wherein the pass transistor is a p-channel field effect ("PFET") transistor.

8. The system of claim 1, wherein the pass transistor is an n-channel field effect ("NFET") transistor, and the system further comprises a charge pump configured to set a source voltage level to the error amplifier.

9. The system of claim 8, wherein the current-controlled oscillator is configured to provide control signals to the charge pump.

10. The system of claim 8, further comprising a hybrid bias current generator coupled to the current-controlled oscillator, wherein the hybrid-bias current generator is configured to change a frequency of the current-controlled oscillator based on a current through the pass transistor.

11. The system of claim 1, further comprising a scaling amplifier coupled to the reference input.

12. The system of claim 1, wherein the LDO circuit is part of an integrated circuit.

13. A low dropout regulator (LDO) circuit, comprising:

an error amplifier having an amplifier input, a reference input and an amplifier output;

a pass device having a control terminal and an output terminal, the output terminal coupled to the amplifier input, and the pass device configured to pass current to the output terminal based on a control signal at the control terminal; and a frequency-dependent resistance device coupled between the amplifier ouput and the pass device, in which a resistance of the frequency-dependent resistance device is adjustable by non-overlapping clock phases based on a current through the pass device.

14. The LDO circuit of claim 13, further comprising a buffer coupled between the amplifier output and the control terminal.

15. The LDO circuit of claim 14, wherein the frequency-dependent resistance device has a terminal coupled between the amplifier output and the buffer.

16. The LDO circuit of claim 14, wherein the frequency-dependent resistance device has a terminal coupled between the buffer and the pass device.

17. The LDO circuit of claim 14, wherein the frequency-dependent resistance device has: a first terminal coupled between the amplifier output and the buffer; and a second terminal coupled between the buffer and the pass device.

* * * * *